US010870313B2

(12) United States Patent
Lacasse-Veilleux et al.

(10) Patent No.: US 10,870,313 B2
(45) Date of Patent: Dec. 22, 2020

(54) KIT OF DECORATIVE WALL PANELS AND ENCLOSURES MADE THEREOF

(71) Applicant: Maax Bath, Inc., Lachine (CA)

(72) Inventors: Christine Lacasse-Veilleux, Montreal (CA); Steve Donnelly, Saint-Antoine de Tilly (CA)

(73) Assignee: Maax Bath Inc, Lachine (CA)

( * ) Notice: Subject to any disclaimer, the term of this patent is extended or adjusted under 35 U.S.C. 154(b) by 0 days.

(21) Appl. No.: 16/388,663

(22) Filed: Apr. 18, 2019

(65) Prior Publication Data

US 2019/0322127 A1 Oct. 24, 2019

Related U.S. Application Data

(60) Provisional application No. 62/659,901, filed on Apr. 19, 2018.

(51) Int. Cl.

| | |
|---|---|
| ***B44F 7/00*** | (2006.01) |
| ***E04F 13/07*** | (2006.01) |
| ***B44C 5/04*** | (2006.01) |
| ***E04C 2/00*** | (2006.01) |

(52) U.S. Cl.

CPC ..... *B44F 7/00* (2013.01); *B44C 5/0461* (2013.01); *E04F 13/07* (2013.01); *E04C 2002/007* (2013.01)

(58) Field of Classification Search

CPC ..... B44F 7/00; E04F 13/07; E04F 13/0894; E04F 13/185; B44C 5/0461; B44C 1/28; E04C 2002/007

See application file for complete search history.

(56) References Cited

U.S. PATENT DOCUMENTS

| | | | | |
|---|---|---|---|---|
| 5,142,836 | A * | 9/1992 | Kearns | E04F 13/0871 52/314 |
| 6,516,476 | B1 * | 2/2003 | Thums | B44C 3/12 4/584 |
| 8,640,390 | B2 * | 2/2014 | Schlueter | A47K 3/405 52/34 |
| 9,504,359 | B2 * | 11/2016 | Seckler | E04F 13/0873 |
| 9,506,253 | B2 * | 11/2016 | Rosko | E04F 13/0873 |
| 9,518,392 | B2 * | 12/2016 | Morneau | B29C 70/305 |
| 10,144,243 | B2 * | 12/2018 | Domanico | B44C 5/04 |
| 10,273,697 | B2 * | 4/2019 | Horton | E04F 13/0866 |
| 2007/0187864 | A1 * | 8/2007 | Mincey | B29C 33/3878 264/219 |

(Continued)

*Primary Examiner* — Rodney Mintz

(74) *Attorney, Agent, or Firm* — Bradley Arant Boult Cummings; Timothy L. Capria; Phillip E. Walker

(57) ABSTRACT

There is described a shower enclosure and kit of walls therefor. The kit of decorative wall panels comprise a first wall panel including a front face, the front face of the first wall panel defining a first decorative pattern and including a relief element, a second wall panel including a front face, the front face of the second wall panel defining a second decorative pattern, and a connecting assembly for connecting the first wall panel adjacent to the second wall panel. The first decorative pattern of the first wall panel and the second decorative pattern of the second wall panel are configured to counteract a visual distortion caused by the relief element of the first wall panel when the first wall panel is adjacent to the second wall panel.

20 Claims, 32 Drawing Sheets

(56) References Cited

U.S. PATENT DOCUMENTS

| | | | | |
|---|---|---|---|---|
| 2008/0115437 | A1* | 5/2008 | Bordener | B29C 48/21 52/311.1 |
| 2008/0250558 | A1* | 10/2008 | Torres | A47K 3/30 4/614 |
| 2011/0183153 | A1* | 7/2011 | Schlueter | E04F 15/02005 428/600 |
| 2013/0019552 | A1* | 1/2013 | Murdock | E04F 13/0862 52/506.01 |
| 2014/0331585 | A1* | 11/2014 | Morneau | E04F 13/00 52/311.1 |
| 2015/0024166 | A1* | 1/2015 | Bilodeau | B44F 9/00 428/141 |
| 2015/0107018 | A1* | 4/2015 | Vagedes | A47K 3/161 4/584 |
| 2015/0300028 | A1* | 10/2015 | Chase | E04F 13/0885 52/588.1 |
| 2015/0361673 | A1* | 12/2015 | Rosko | E04F 13/0898 52/272 |
| 2016/0160496 | A1* | 6/2016 | Seckler | A47K 3/28 52/272 |
| 2016/0236507 | A1* | 8/2016 | Domanico | B44C 1/22 |
| 2017/0071415 | A1* | 3/2017 | Rosko | E04F 13/0873 |
| 2017/0071416 | A1* | 3/2017 | Seckler | A47K 3/283 |
| 2017/0274702 | A1* | 9/2017 | Bilodeau | B44C 5/0446 |
| 2018/0058076 | A1* | 3/2018 | Horton | E04F 13/0866 |

* cited by examiner

KIT OF DECORATIVE WALL PANELS AND ENCLOSURES MADE THEREOF

TECHNICAL FIELD

The present invention relates to the field of decorative wall panels, and more particularly to kits of decorative wall panels for enclosures such as shower and/or bath tub enclosures.

BACKGROUND

Showers and bath tubs are often installed adjacent to a wall or partially surrounded by two or more walls. In some instances, the installation of the shower or bath tub requires that the contractor position the base of the shower or bath tub adjacent to the drywall or concrete panels affixed to the vertical wooden or metal studs of the bathroom wall. Thereafter, materials such as waterproof membranes and tile or stone panels are installed on the remaining exposed portion of the drywall or concrete panels to provide better aesthetic characteristics to the shower or bath tub enclosure and to prevent water leakage.

In other instances, decorative wall panels are used, such as those described in US Publication No. 2017/274702 and U.S. Pat. No. 9,518,392, incorporated herein by reference. In this case, it may not be necessary to provide drywall or concrete panels on the wooden or metal studs of the bathroom wall. The contractor rather positions the bath tub or shower base directly adjacent to the vertical studs, and the decorative wall panels are then secured directly to the exposed portion of the studs, thereby avoiding the need for additional drywall or concrete panel support.

Whether using waterproof membranes and tile or stone panels installed on drywall or concrete panels or using decorative wall panels, providing storage on the walls of the shower or bath tub enclosure is mostly limited to shelves, soap dishes, handles or other elements that project away from the wall, whether they are integrally formed with wall panels prior to installation (e.g. with molded polymer decorative wall panels) or they are subsequently attached thereto (e.g. shelves attached to tiled wall using threaded fasteners). In other instances, decorative panels can include elements such as niches, alcoves or other similar elements which are recessed relative to the main plane of the decorative surface (i.e. they project toward the bathroom wall). In some configurations where decorative panels are used, niches are sized and shaped to fit between two adjacent studs so that the main decorative surface of the decorative wall panel lies against the studs while the recessed niche or recessed element is received between the studs. In other configurations where decorative panels are used, an air-space is defined between the main surface of the decorative wall panel and the studs, while the rear side of the recessed niche lies against the vertical studs of the bathroom wall. In either application, the configuration (i.e. the size, shape, and positioning) of the niche is dictated by the presence of the vertically extending studs of the wall. This limits the possible niche configurations.

Furthermore, while these configurations may be suitable with decorative wall panels having a uniform color or random motives, they hardly work with decorative panels having symmetrical patterns, faux-tile patterns or other kind of patterns. This is because the relief required to incorporate a niche or a recessed relief element creates a visual distortion of the symmetrical patterns, which makes them less satisfactory from an aesthetic point of view.

To avoid drawbacks associated with the use of recessed relief elements with decorative panels with faux-tile patterns or other types of symmetrical patterns, it is possible to mount a decorative wall panel with the niche or recessed element resting against the vertically extending studs on the wall bathroom. The other portions of the faux-tile decorative panels are then assembled so as to provide a generally constant air-space with the studs of the wall, which means that the lower end of the decorative wall panel is spaced-apart from the studs of the walls. To prevent water leakage and create an aesthetically pleasing look to the assembly, the decorative wall surface must be aligned with the top portion of the shower base or bath tub, and therefore the contractor must install the shower base or bath tub at a distance from the wall of the bathroom, which tends to complicate the installation and translates into a reduced bathroom space.

Therefore, it would be desirable to be provided with a kit of wall panels for a shower or a bath tub enclosure that would overcome at least some of the identified drawbacks.

SUMMARY

According to a first broad aspect, there is provided a kit of decorative wall panels, comprising a first wall panel including a front face, the front face of the first wall panel defining a first decorative pattern and including at least one relief element. The kit further comprises a second wall panel including a front face, the front face of the second wall panel defining a second decorative pattern. A connecting assembly connects the first wall panel to the second wall panel. The wall panels display decorative patterns configured to counteract any visual distortion caused by any relief elements of the first wall panel when the first wall panel is connected to the second wall panel.

In one feature, the kit further comprises a third wall panel including a front face, the front face of the third wall panel defining a third decorative pattern, and a second connecting assembly for connecting the third wall panel to any one of the first wall panel and the second wall panel. In this feature, the first decorative pattern of the first wall panel, the second decorative pattern of the second wall panel, and the third decorative pattern of the third wall panel are configured to counteract the visual distortion caused by the at least one relief element when the first wall panel, the second wall panel, and the third wall panel are connected to each other.

In another feature, the first wall panel comprises a relief element recessed relative to the front face of the first wall panel. Preferably, the recessed relief element comprises a niche.

In a further feature, the first decorative pattern of the front face of the first wall panel, the second decorative pattern of the front face of the second wall panel, and the third decorative pattern of the front face of the third wall panel define a symmetrical pattern. Preferably, the symmetrical pattern is a faux-tile pattern.

In still a further feature, the first connecting assembly and the second connecting assembly are configured to allow removably connecting the first wall panel, the second wall panel, and the third wall panel. Preferably, the first connecting assembly and the second connecting assembly each comprises a plurality of dowels and a corresponding plurality of pockets for receiving the plurality of dowels.

In another feature, the kit is mountable to a shower base or a bath tub to define an enclosure.

According to another broad aspect, there is provided a kit of decorative wall panels, comprising a first wall panel mountable to a structure and including a back face, a front face and at least one relief element. The relief element is recessed relative to the front face of the first wall panel and includes a back face and a front face. The first wall panel is configured for the back face of the relief element to rest against the structure. A second wall panel includes a back face and a front face and is mountable on the structure. A first connecting assembly is also provided for connecting the first wall panel to the second wall panel.

In one feature, the kit further comprises a third wall panel including a back face, a front face, and a second connecting assembly for connecting the third wall panel to any one of the first wall panel and the second wall panel. The third wall panel is mountable on the structure and configured for the back face of the third wall panel to abut the structure.

In another feature, the structure comprises a wall or wall studs. Preferably, the wall or wall studs are adjacent to a shower base or a bath tub.

In still another feature, the recessed relief element comprises a niche.

In yet another feature, any one of the first connecting assembly and the second connecting assembly are configured to allow removably connecting any one of the first wall panel, the second wall panel, and the third wall panel.

In another feature, each of the first connecting assembly and the second connecting assembly comprises a plurality of dowels and a corresponding plurality of pockets for receiving the plurality of dowels.

In a further feature, the front face of the first wall panel extends between a lower end and an upper end and comprises an intermediate portion therebetween. In this feature, the front face includes an inclined lower face extending forwardly from the lower end towards the intermediate portion, and a vertical upper face extending upwardly from the intermediate portion toward the upper end. Preferably, at least one relief element is located on the intermediate portion.

In still a further feature, the front face of the first wall panel defines a first decorative pattern and the front face of the second wall panel defines a second decorative pattern. Preferably, the first decorative pattern of the first wall panel and the second decorative pattern of the second wall panel are configured to counteract the visual distortion caused by any relief elements of the first wall panel when the first wall panel is connected to the second wall panel In still a further feature, the front face of the first wall panel defines a first decorative pattern, the front face of the second wall panel defines a second decorative pattern and the front face of the third wall panel defines a third decorative pattern. Preferably, the first decorative pattern of the first wall panel, the second decorative pattern of the second wall panel and the third decorative panel of the third wall panel are configured to counteract the visual distortion caused by any reliefs element of the first wall panel when the first wall panel is connected to the second wall panel and to the third wall panel.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
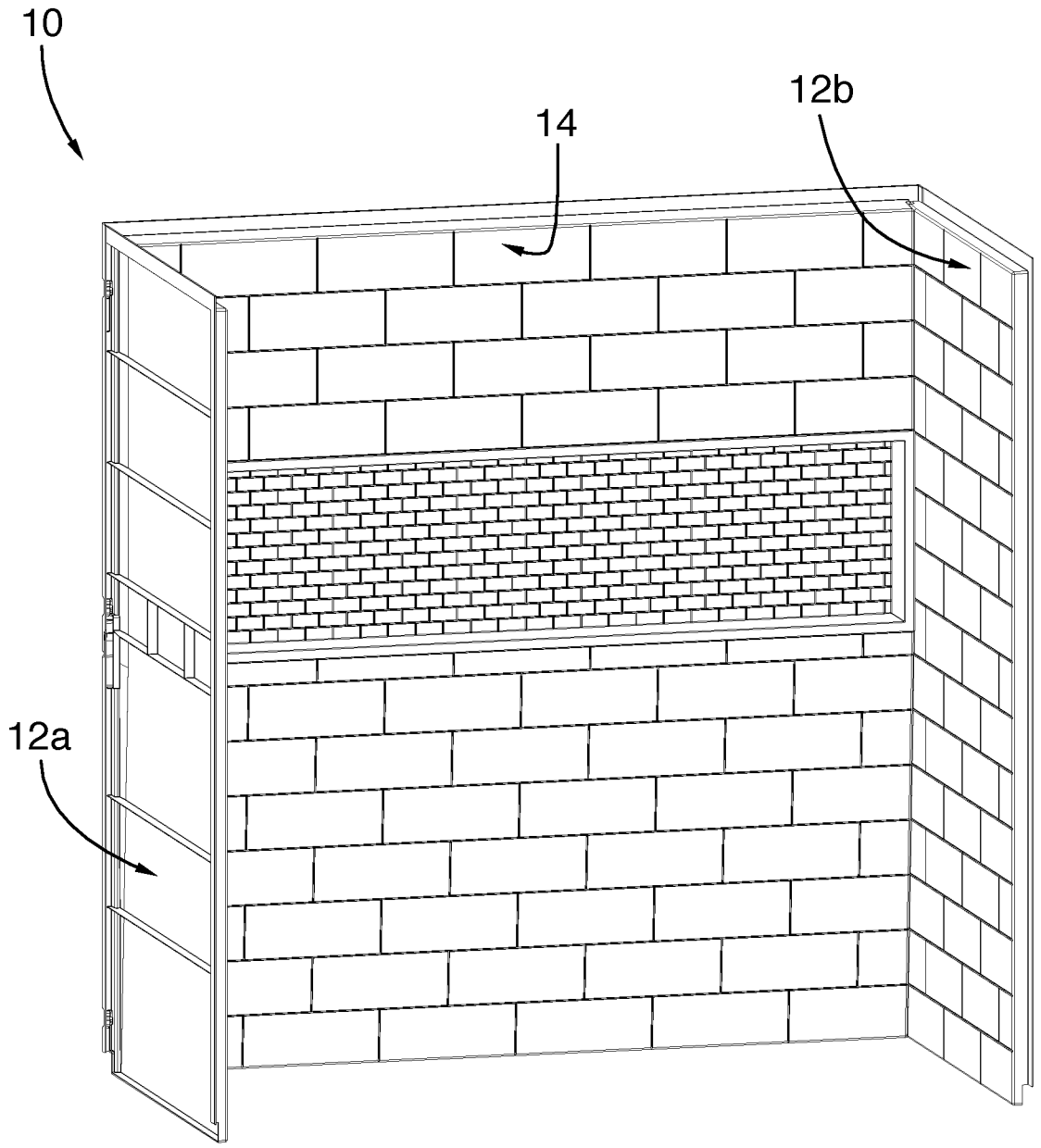
FIG. 1 is a front left perspective view of a kit of decorative wall panels showing a pair of sidewall panels and a backwall panel attached to one another, in accordance with an embodiment.
Figure 2:
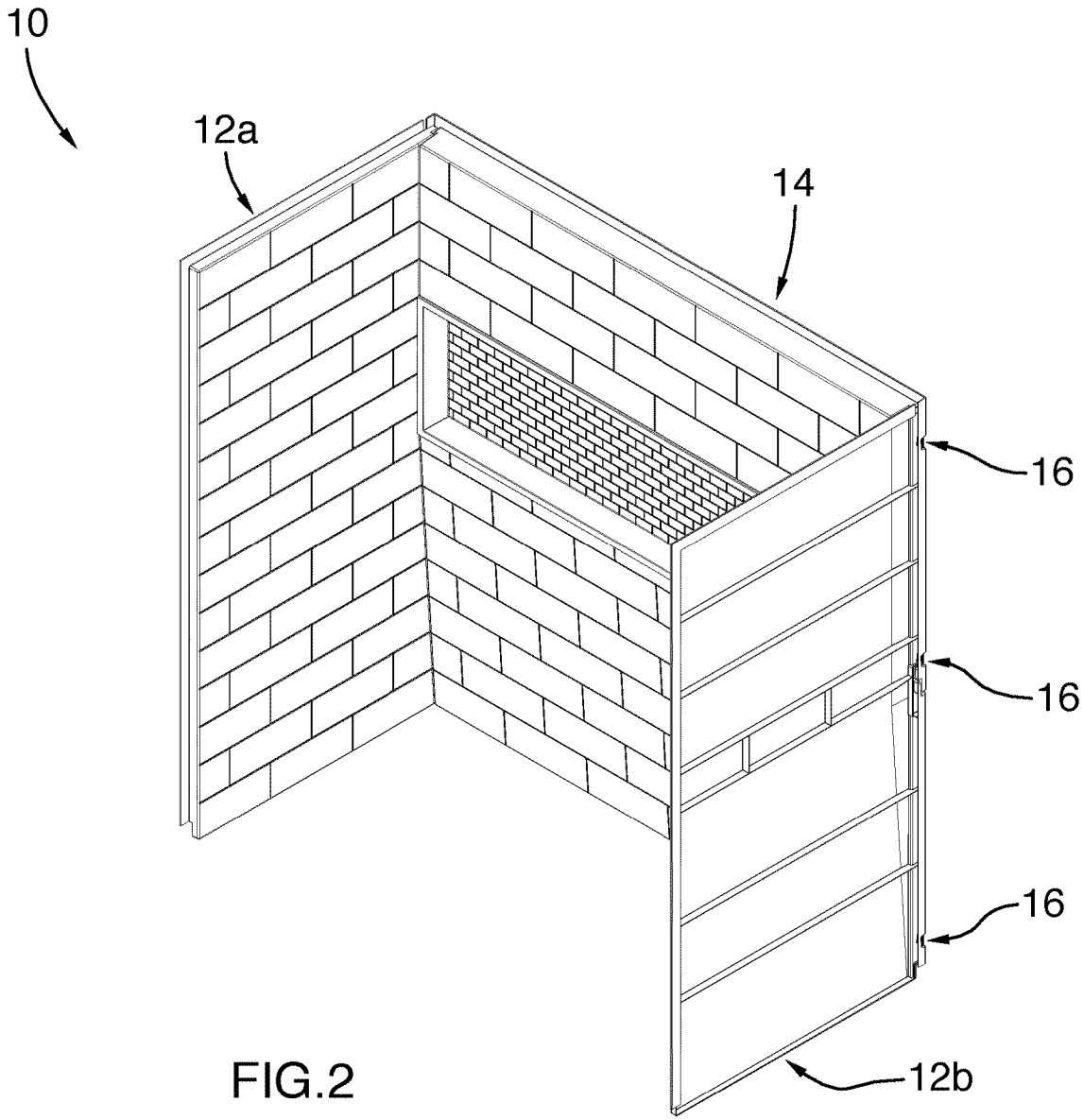
FIG. 2 is a front right perspective view of the kit of decorative wall panels shown in FIG. 1.

FIGS. 1A to 4 illustrate a decorative wall panel kit 10 for assembly with a bath tub or a shower base for forming an enclosure. The decorative wall panel kit 10 includes a pair of spaced-apart sidewall panels 12*a*, 12*b* and a center, backwall panel 14 extending between the two sidewall panels 12*a*, 12*b* and secured thereto via an interlockable connecting assembly 16. As best shown in FIG. 2, the decorative wall panel kit 10 produces a faux-tile pattern.

Turning to FIGS. 5 to 13, sidewall panels 12*a*, 12*b* will be described. The two sidewall panels 12*a*, 12*b* being mirror images of one another, only sidewall 12*a* will be described. The person skilled in the art will appreciate that the same description also applies to side panel 12*b*, with the appropriate modifications. The person skilled in the art will also understand that the sidewall panels 12*a* and 12*b* can be configured to receive one or more faucet, spout, shower head or the same (not shown). Sidewall panel 12*a* is generally flat and comprises a top end 20, a lower end 22, a left end 24 and a right end 26. Sidewall panel 12*a* also comprises a back face 28 (shown in FIG. 7) which is adjacent to the wall or studs once the sidewall panel 12*a* is installed, and a front face 30 on which is defined with a faux-tile pattern.

Figure 6:
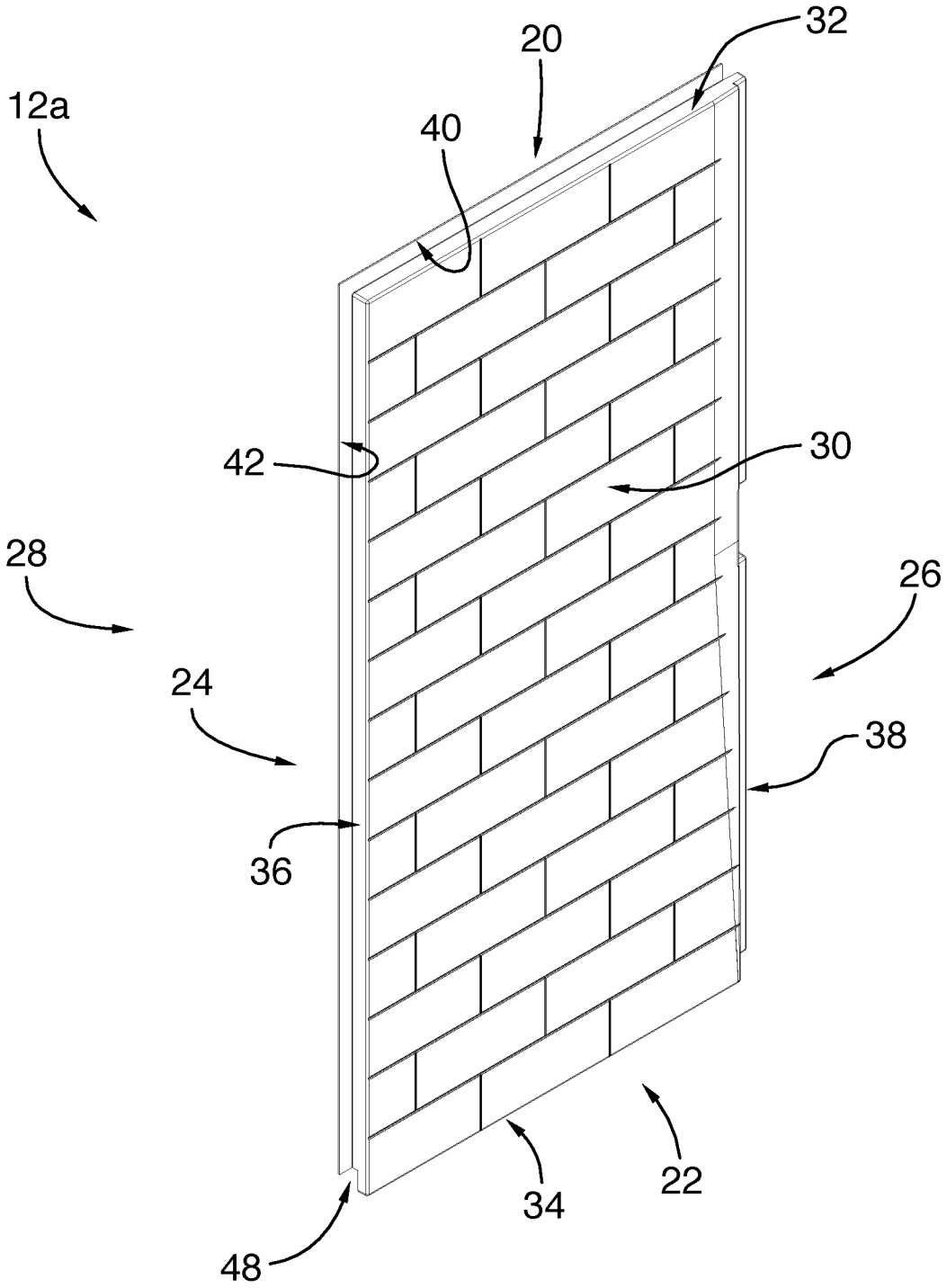
FIG. 6 is a front left perspective view of the sidewall panel shown in FIG. 5.

Extending about the periphery of the top, lower, left and right ends 20, 22, 24, 26, perpendicular to the front face 30 and toward the room when sidewall panel 12*a* is installed, are perpendicularly extending top perimeter side 32, lower perimeter side 34, left perimeter side 36, and right perimeter side 38 (best shown in FIG. 6). Extending perpendicular to top, lower, left and right perimeter sides 32, 34, 36, and 38, in a plane separate from, but parallel to the front face 30 of sidewall panel 12*a*, are a top flange 40 and a left flange 42. As it will become apparent to the person skilled in the art, top flange 40 and left flange 42 can be used to secure sidewall panel 12*a* to the wall of the room using glue, screws, nails or any other type of suitable fasteners (not shown). The person skilled in the art will understand that any other suitable securing means can also be used.

Figure 7:
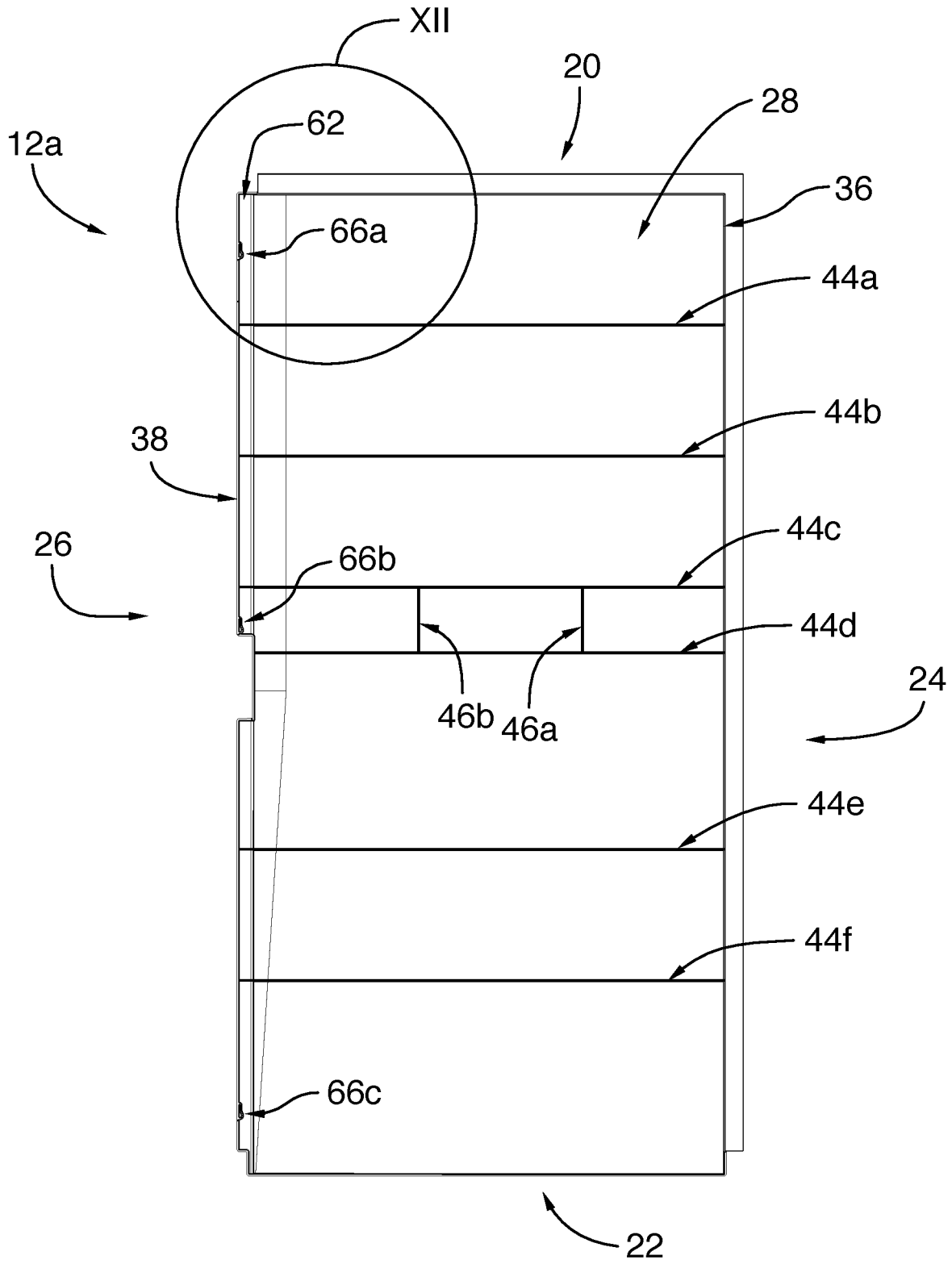
FIG. 7 is a back view of the sidewall panel shown in FIG. 5.

Top, lower, left and right perimeter sides 32, 34, 36, and 38 contribute to the overall rigidity of sidewall panel 12*a*. In the illustrated embodiment, sidewall panel 12*a* further comprises a plurality of cross-members 44*a*-44*f* located on the back face 28 that also contribute to the overall rigidity of sidewall panel 12*a*. As best shown in FIG. 7, cross-members 44*a*-44*f* extend from left perimeter side 36 to right perimeter side 38, perpendicularly thereto, with further cross-members 46*a*, 46*b* connecting cross-members 44*c* and 44*d*. The depth of cross-members 44*a*-44*f* and 46*a*, 46*b* generally correspond to the depth of top, lower, left, and right perimeter sides 32, 34, 36, and 38 such that when the sidewall panel 12*a* is installed, portions of cross-members 44*a*-44*f* and 46*a*-46*b* abut the studs of the wall. As it will be appreciated by, the number and position of cross-members can be modified to achieve specific degrees of rigidity of sidewall panel 12*a*.

Figure 8:
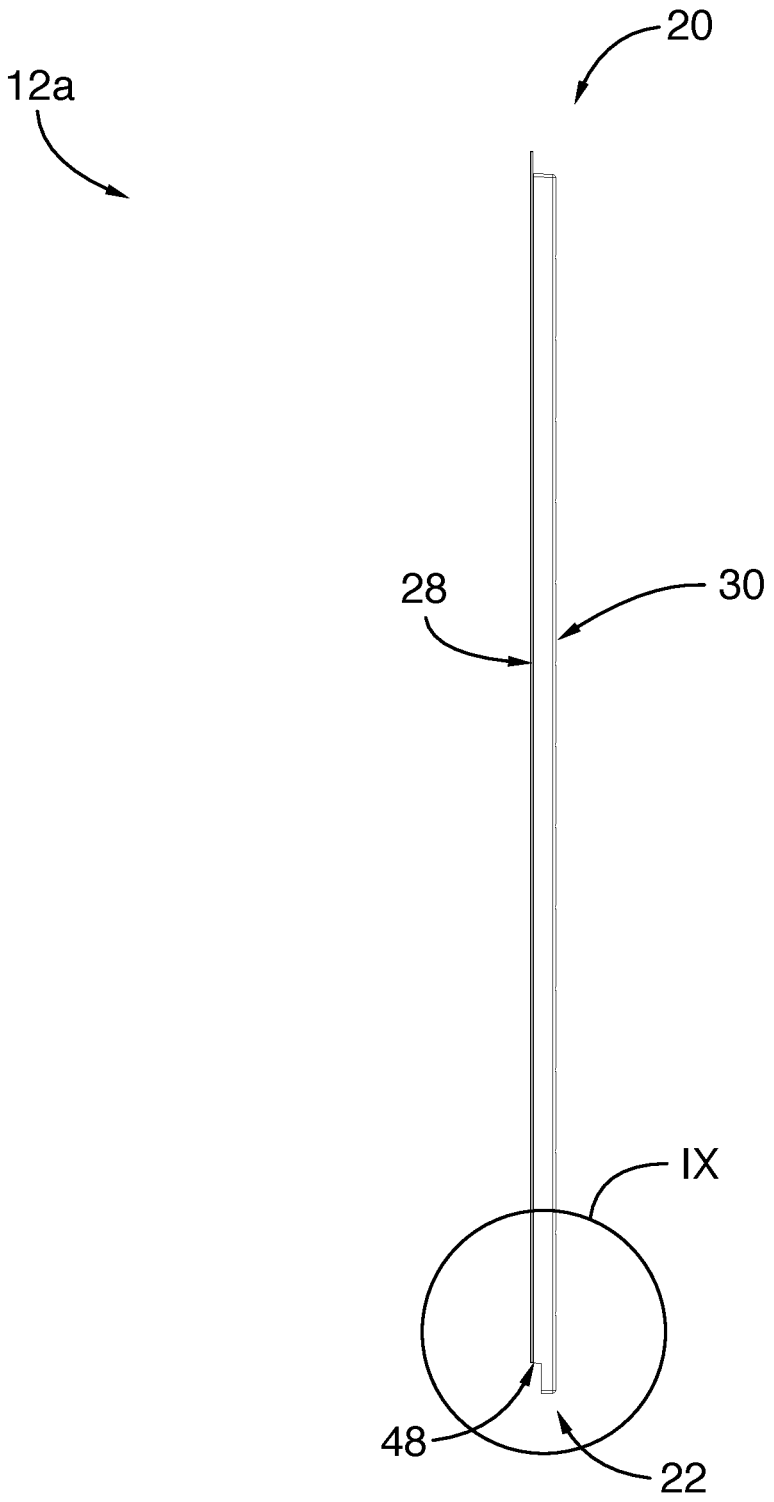
FIG. 8 is a left side view of the sidewall panel shown in FIG. 5.
Figure 9:
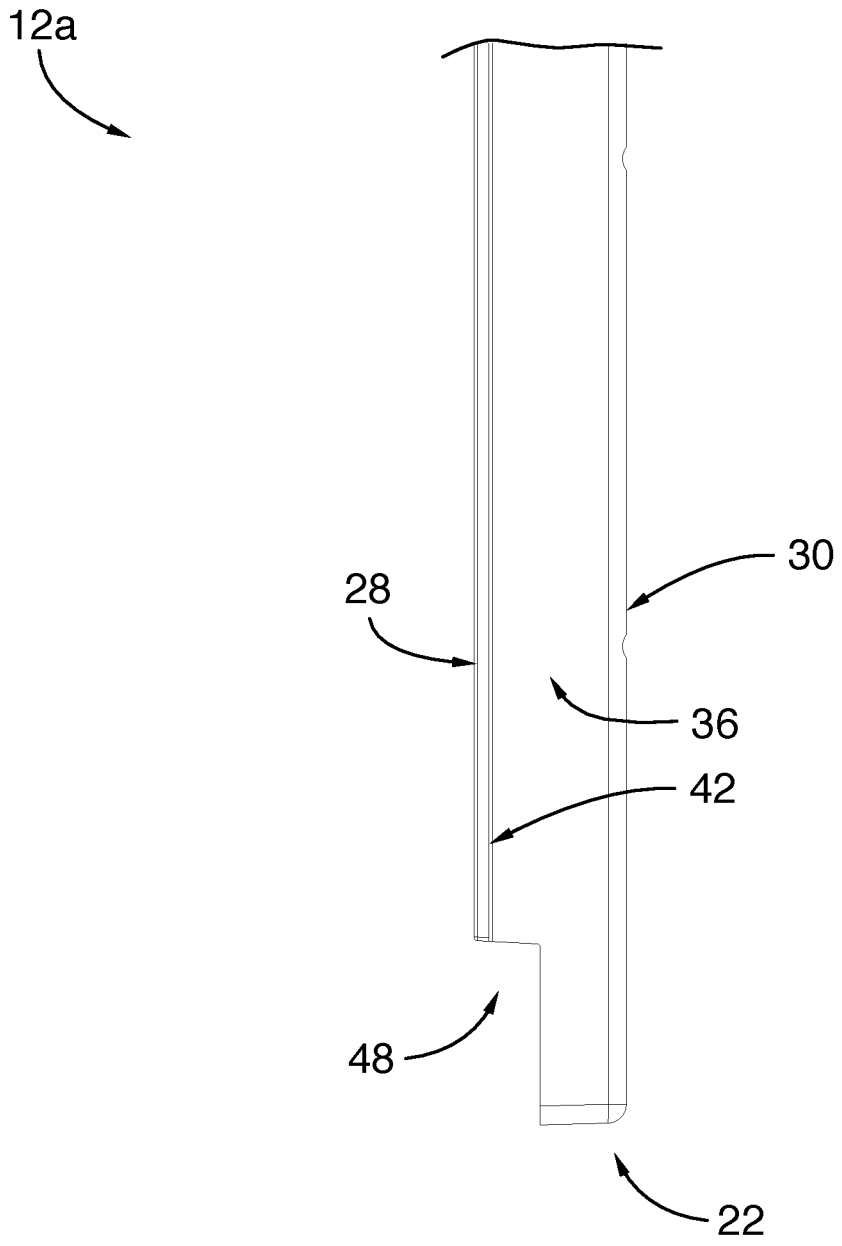
FIG. 9 is an enlarged, partial left side view of the sidewall panel shown in FIG. 5.

At the lower end 22 of sidewall panel 12*a*, a notch 48 is defined on a slight portion of the left and right perimeter sides 36, 38, and along the length of lower side 34 (best shown in FIGS. 8 and 9). This notch 48 allow overlapping the lower end 22 of sidewall panel 12*a* over a flange extending vertically from the shower base or bath tub to prevent water leakage (not shown). As it will be apparent to the person skilled in the art, a silicon or caulking joint can be applied at the junction of the shower base or bath tub and the lower end 22 of the sidewall panel 12*a* to further prevent water leakage (not shown).

Figure 10:
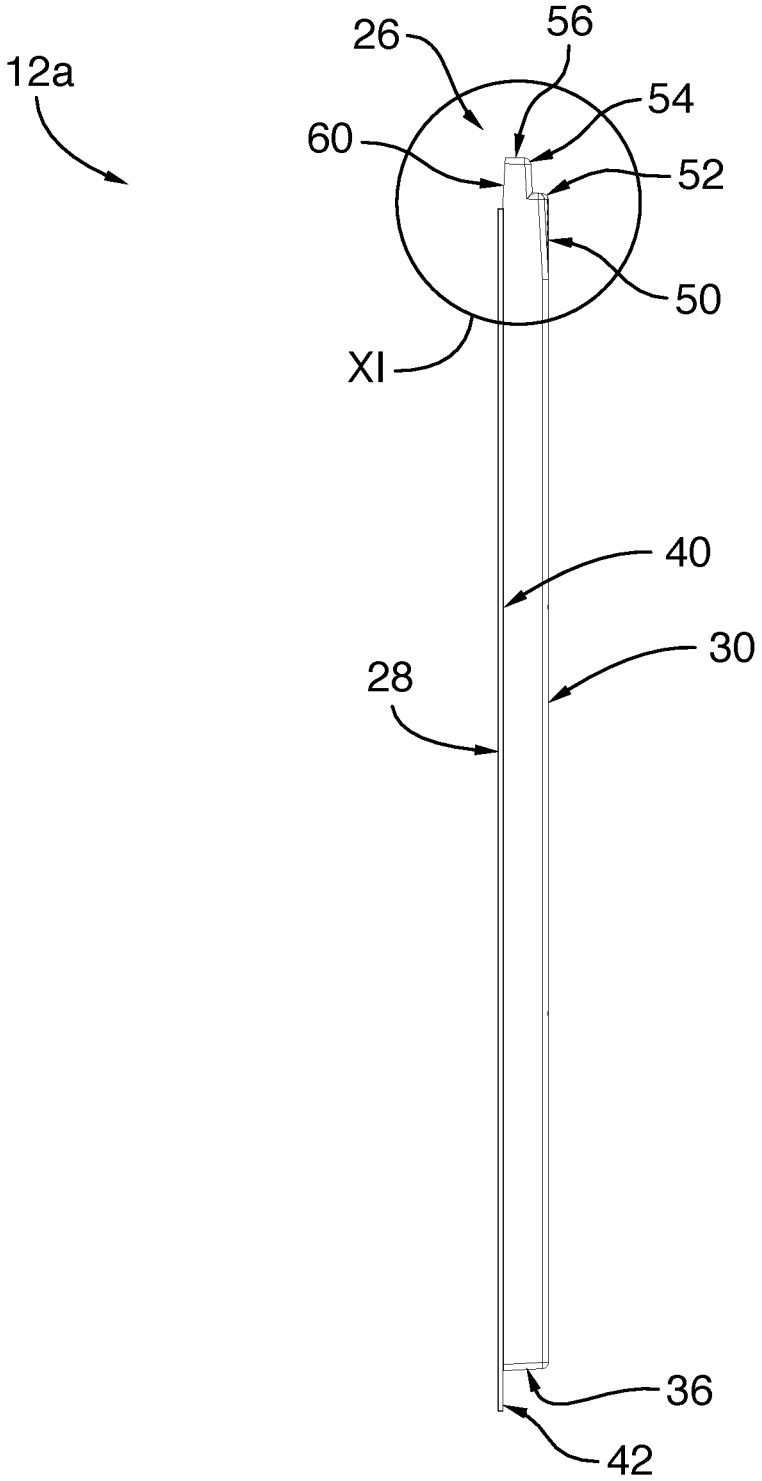
FIG. 10 is a top view of the sidewall panel shown in FIG. 5.
Figure 11:
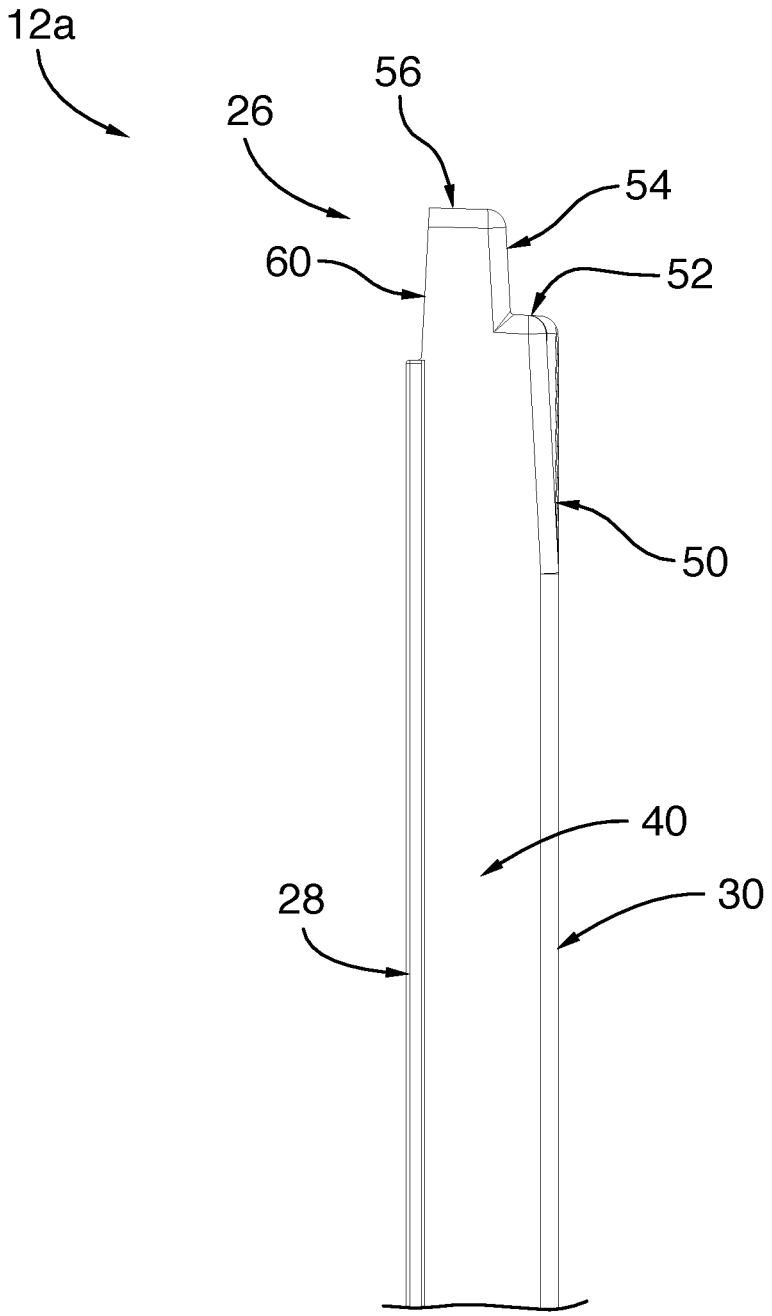
FIG. 11 is an enlarged, partial top view of the sidewall panel shown in FIG. 5, for better showing the right side end thereof.
Figure 12:
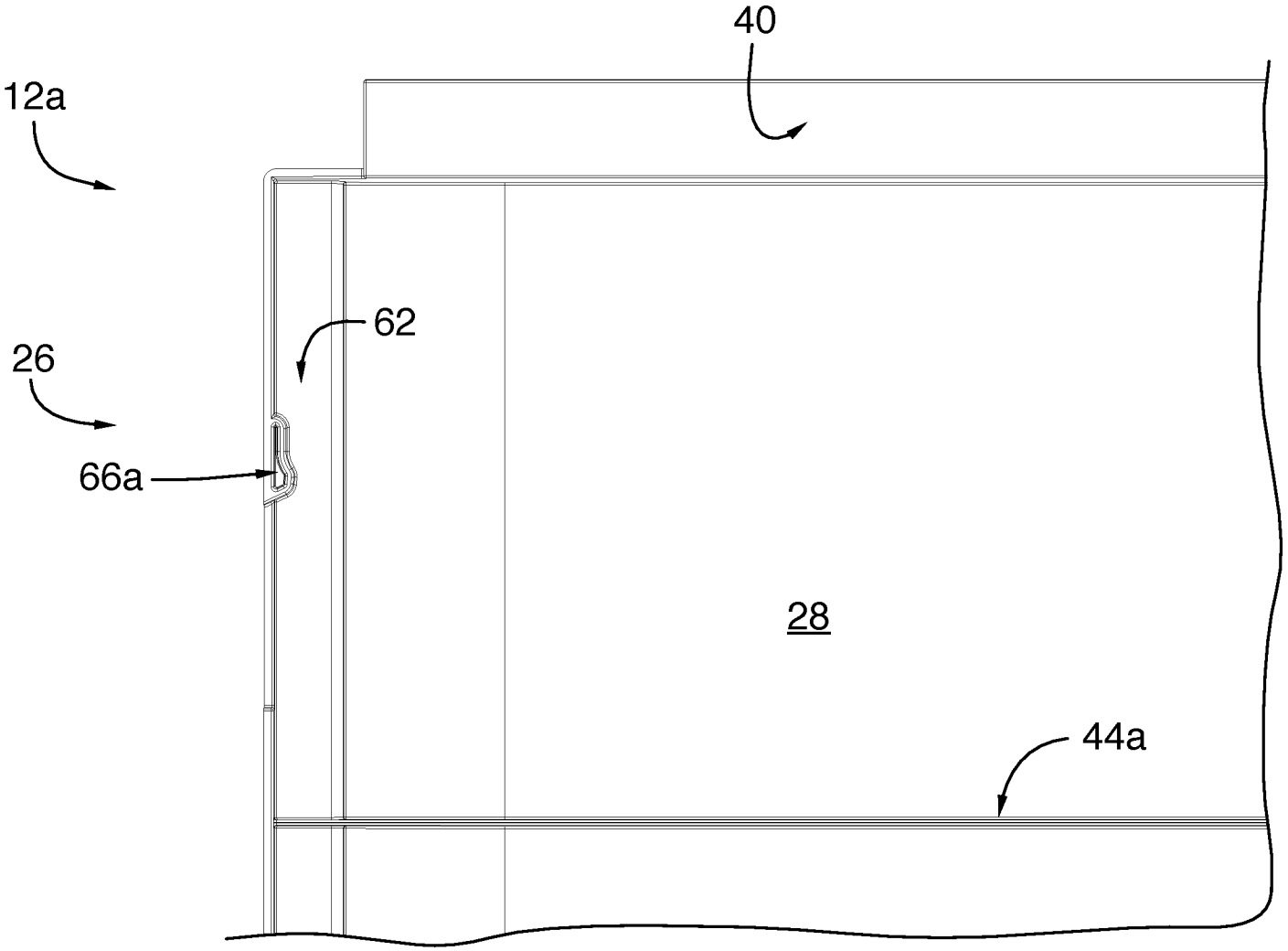
FIG. 12 is an enlarged, partial back view of the sidewall panel shown in FIG. 5, for better showing the first interlockable portion of the interlockable connecting assembly.
Figure 13:
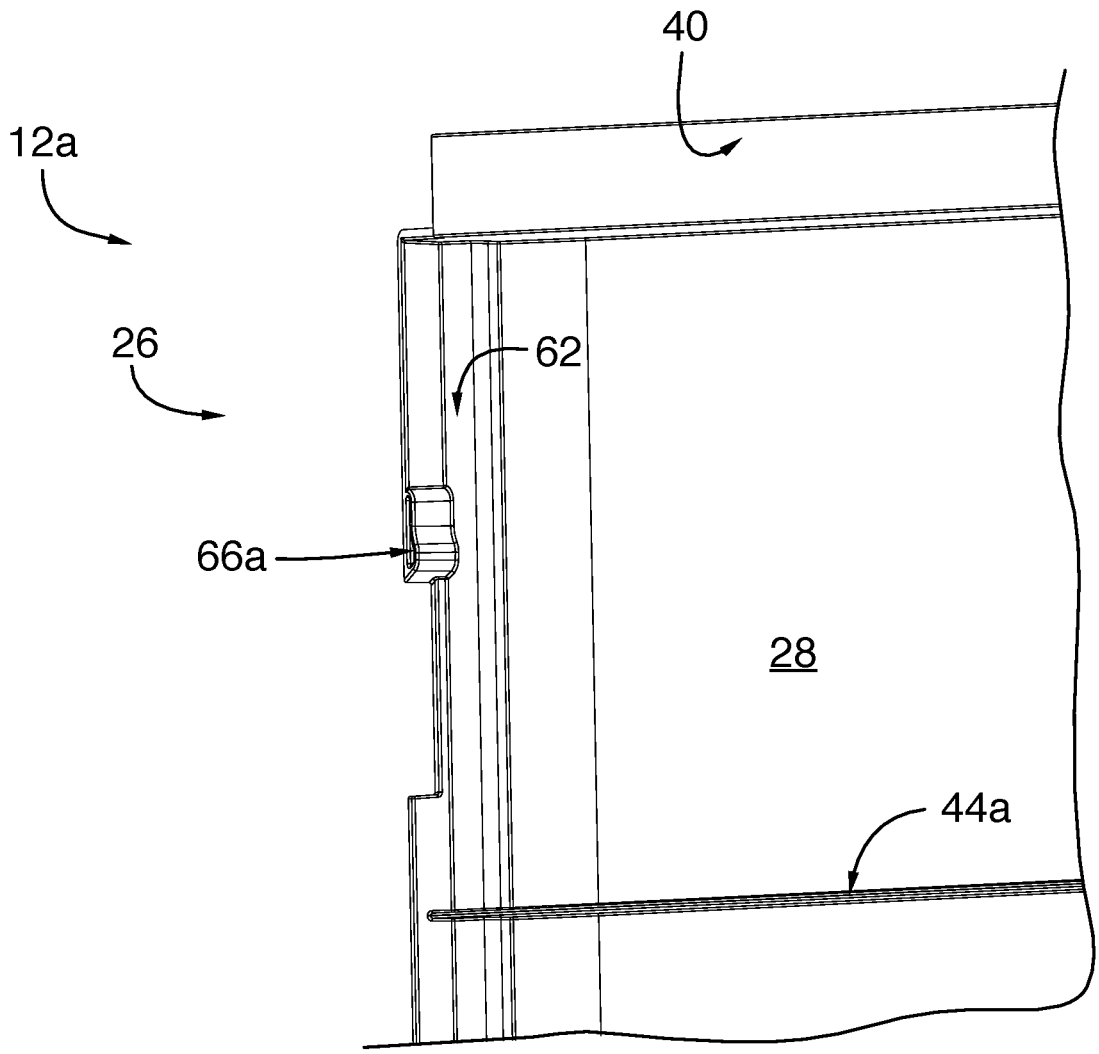
FIG. 13 is an enlarged, partial back perspective view of the sidewall panel shown in FIG. 5, also for better showing the first interlockable portion of the interlockable connecting assembly.

With reference to FIGS. 10 and 11, the right end 26 of sidewall panel 12*a* will be described. As best seen from the top, the right end 26 of sidewall panel 12*a* comprises sequentially, from the right to the left, a first front portion 50 slightly angled relative to the plane of the front face 30 of sidewall panel 12*a*, a first side portion 52 extending perpendicularly to the plane of front face 30, a second front portion 54 extending slightly angularly relative to the front face 30 and a second side portion 56 extending perpendicularly to the plane of the front face 30 of the sidewall panel 12*a*. A notch 60 is provided on the back face 28 of the sidewall panel 12*a*, and along the length of the right end 26 so that the right end 26 of sidewall panel 12*a* collaborates with backwall panel 14 to secure the same together through interlockable connecting assembly 16.

Figure 15:
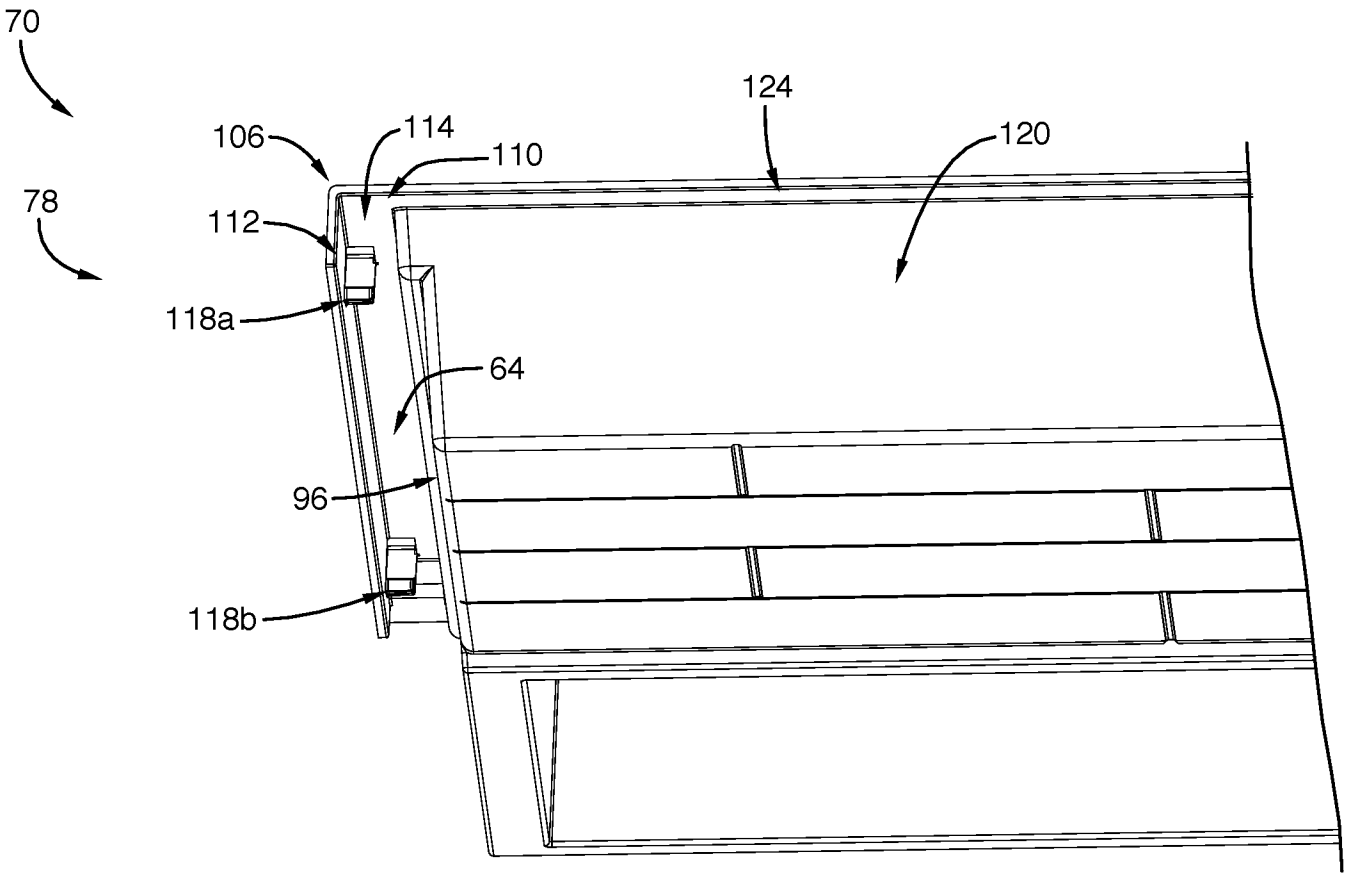
FIG. 15 is a partial top back perspective view of the upper backwall panel shown in FIG. 14, for better showing the second interlockable portion of the interlockable connecting assembly.

The interlockable connecting assembly 16 (best shown in FIGS. 2 and 4) comprises a first interlockable portion 62 defined on the right end 26 of sidewall panel 12*a* (shown in FIGS. 12 and 13) and a second interlockable portion 64 defined on the backwall panel 14 (shown in FIG. 15). In the illustrated embodiment, the first interlockable portion 62 is integrally molded with sidewall panel 12*a* and comprises a plurality of vertically spaced-apart dowels 66*a*-66*c* (best shown in FIG. 7) extending outwardly from the back face 28 (i.e. toward the wall of the room when the sidewall panel 12*a* is installed).

Turning now to FIGS. 14 to 26, backwall panel 14 will now be described. In the illustrated embodiment, backwall panel 14 comprises an upper backwall panel 70 (shown in FIGS. 14 to 18) and a lower backwall panel 72. The person skilled in the art will understand that the backwall panel 14, including the upper backwall panel 70 and the lower backwall panel 72, can be configured to receive one or more faucet, spout, shower head or the same (not shown).

With reference to FIGS. 14 to 18, the upper backwall panel 70 will now be described. The upper backwall panel 70 comprises a top end 74, a lower end 76, a left end 78, and a right end 80. Defined between the top end 74 and the lower end 76 are a flat portion 82 extending from the top end 74 to an intermediate location 84, and a niche portion 86 extending from the intermediate location 84 to the lower end 76, both the flat portion 82 and the niche portion 86 extending substantially between the left and right ends 78, 80. The niche portion 86 comprises a frame 88 surrounding a recessed portion 90 having a generally rectangular shape.

Projecting backwardly from the flat portion 82 and niche portion 86 are top, lower, left and right peripheral walls 92, 94, 96 and 98. Left peripheral wall 96 is configured to complement the right end 26 of sidewall panel 12*a*, while the right peripheral wall 98 is configured to complement the corresponding end 26 of sidewall panel 12*b*. Taking left peripheral wall 96 as an example (best shown in FIG. 18), it comprises a first portion 100 extending generally perpendicular to the plane of the backwall panel 14 and configured to abut first front portion 50 of sidewall panel 12*a*, a first side portion 102 extending generally parallel to the plane of the backwall panel 14 and configured to abut the first side portion 52 of the sidewall panel 12*a*, and a second portion 104 extending generally perpendicular to the plane of the backwall panel 14 and configured to abut the second front portion 54 of the sidewall panel 12*a*. The right peripheral wall 98 being the mirror image of left peripheral wall 96, the person skilled in the art will appreciate that a similar arrangement applies with proper modifications.

Extending from each left and right peripheral walls 96, 98 are L-shaped flanges 106, 108. L-shaped flanges 106, 108 being mirror images of one another, only left L-shaped flange 106 will be described (best shown in FIGS. 15 and 16). The person skilled in the art will understand that a similar description also applies to right L-shaped flange 108. Left L-shaped flange 106 comprises a first portion 110 extending in a plane generally parallel to the plane of the backwall panel 14, and a second portion 112 extending perpendicular to the first portion 110. Together with the left peripheral wall 96, the first and second portions 110, 112 of the left L-shaped flange 106 define a recess 114 for receiving the right end 26 of the left sidewall panel 12*a*, where first portion 110 is adjacent to the second side portion 56 of the sidewall panel 12*a*. Defined in the recess 114 is the second interlockable portion 64 of the interlockable connecting assembly 16 (best shown in FIGS. 15 and 20). The second interlockable portion 64 comprises a plurality of vertically spaced-apart pocket portions 118*a*-118*b* integrally molded with the upper backpanel 70. As best shown in FIGS. 14 to 17, each pocket portion 118*a*-118*b* is open on a vertical inner side (i.e. the side adjacent to the bath tub or shower base enclosed by the sidewall panels 12*a*, 12*b* and backwall panel 14) at the top so that each pocket portion 118*a*-118*b* can receive the corresponding dowel 66*a*-66*b* of the first interlockable portion 62 of the left sidewall panel 12*a*. The second portion 112 of the left L-shaped flange is received in the notch 60 of the left sidewall panel 12*a*.

Figure 14:
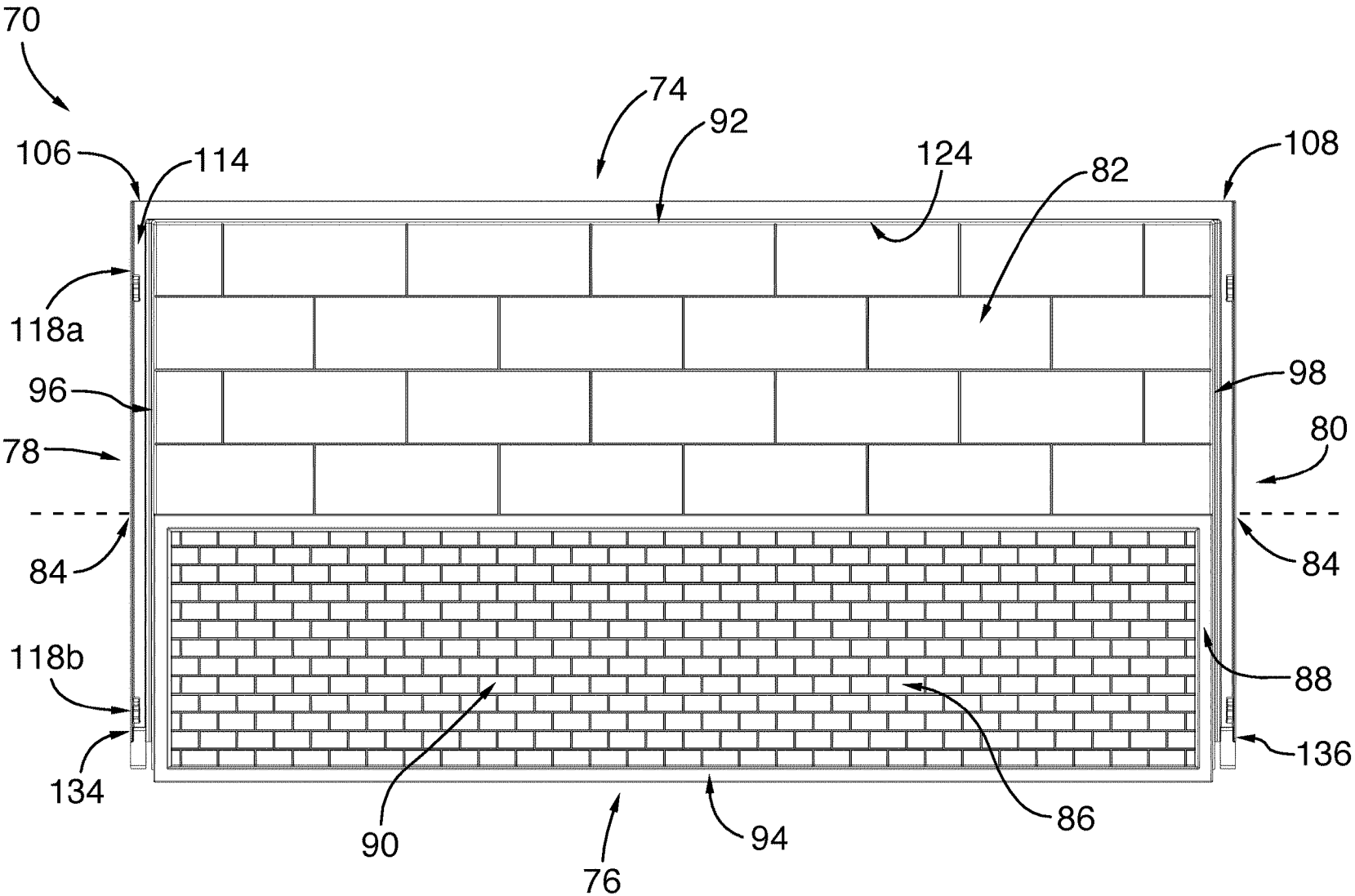
FIG. 14 is a front view of an upper backwall panel of the kit of decorative wall panels shown in FIG. 1, in accordance with an embodiment.
Figure 16:
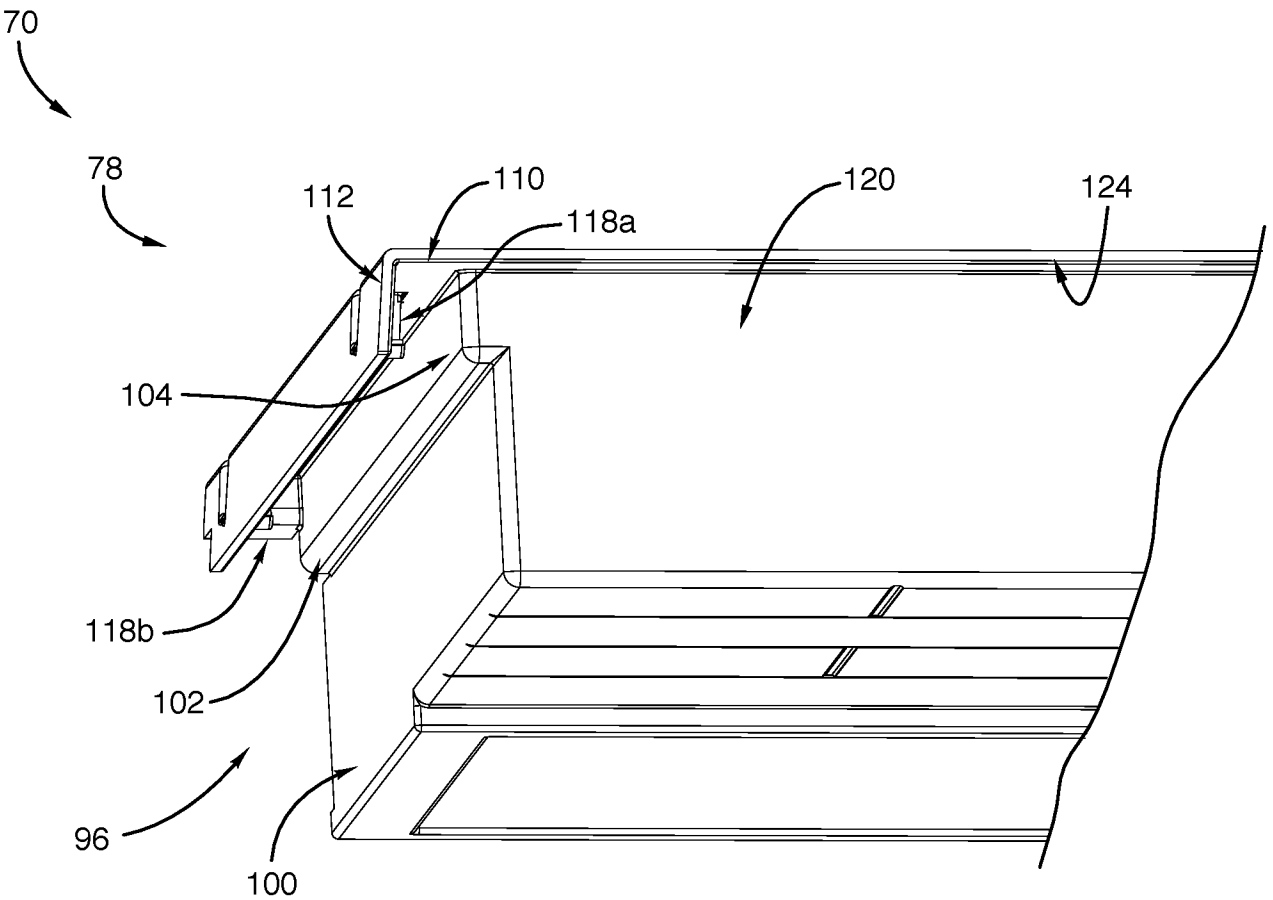
FIG. 16 is another partial top perspective view of the upper backwall panel shown in FIG. 14, also for better showing the second interlockable portion of the interlockable connecting assembly.
Figure 17:
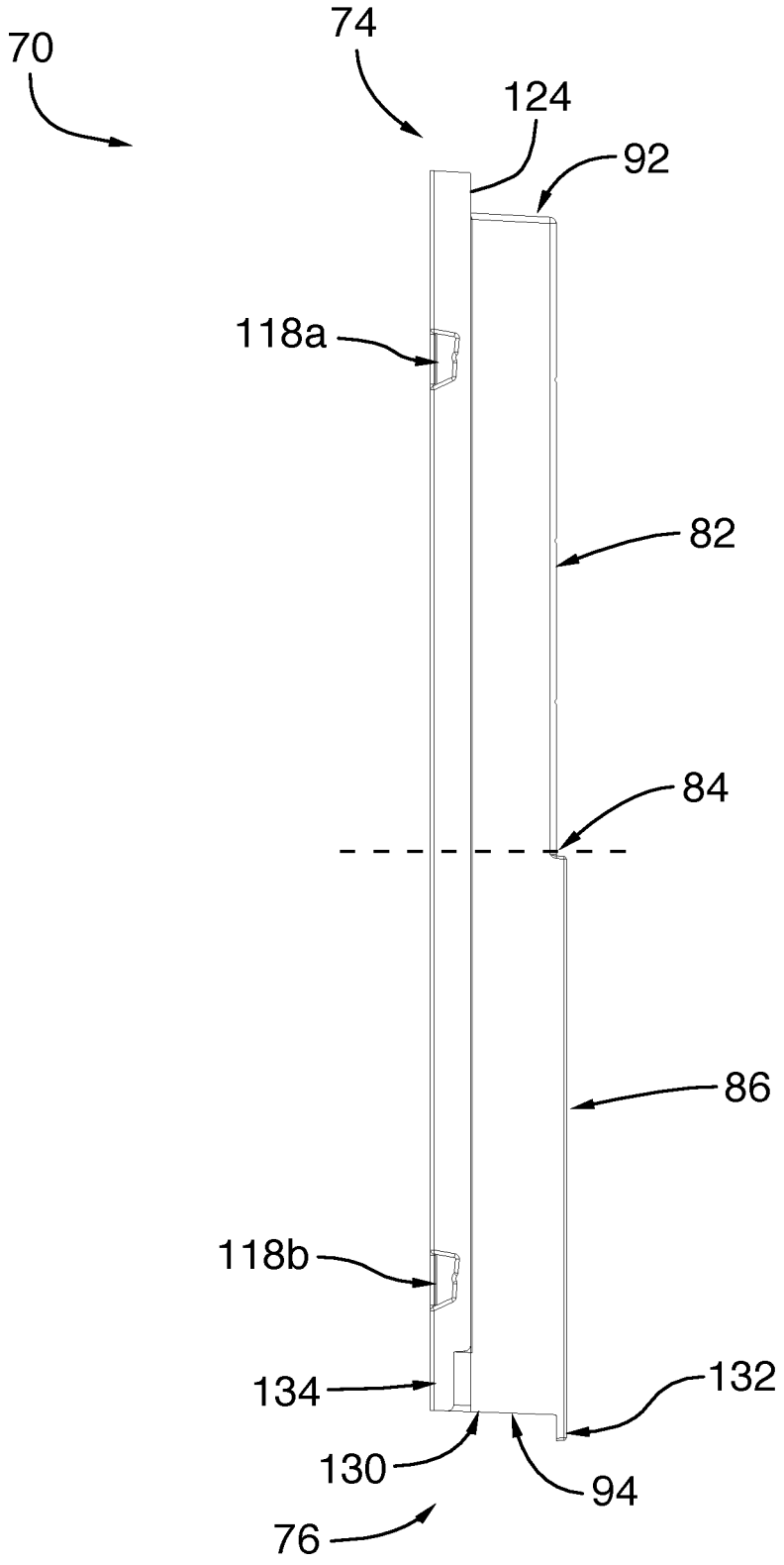
FIG. 17 is a side view of the upper backwall panel shown in FIG. 14.
Figure 18:
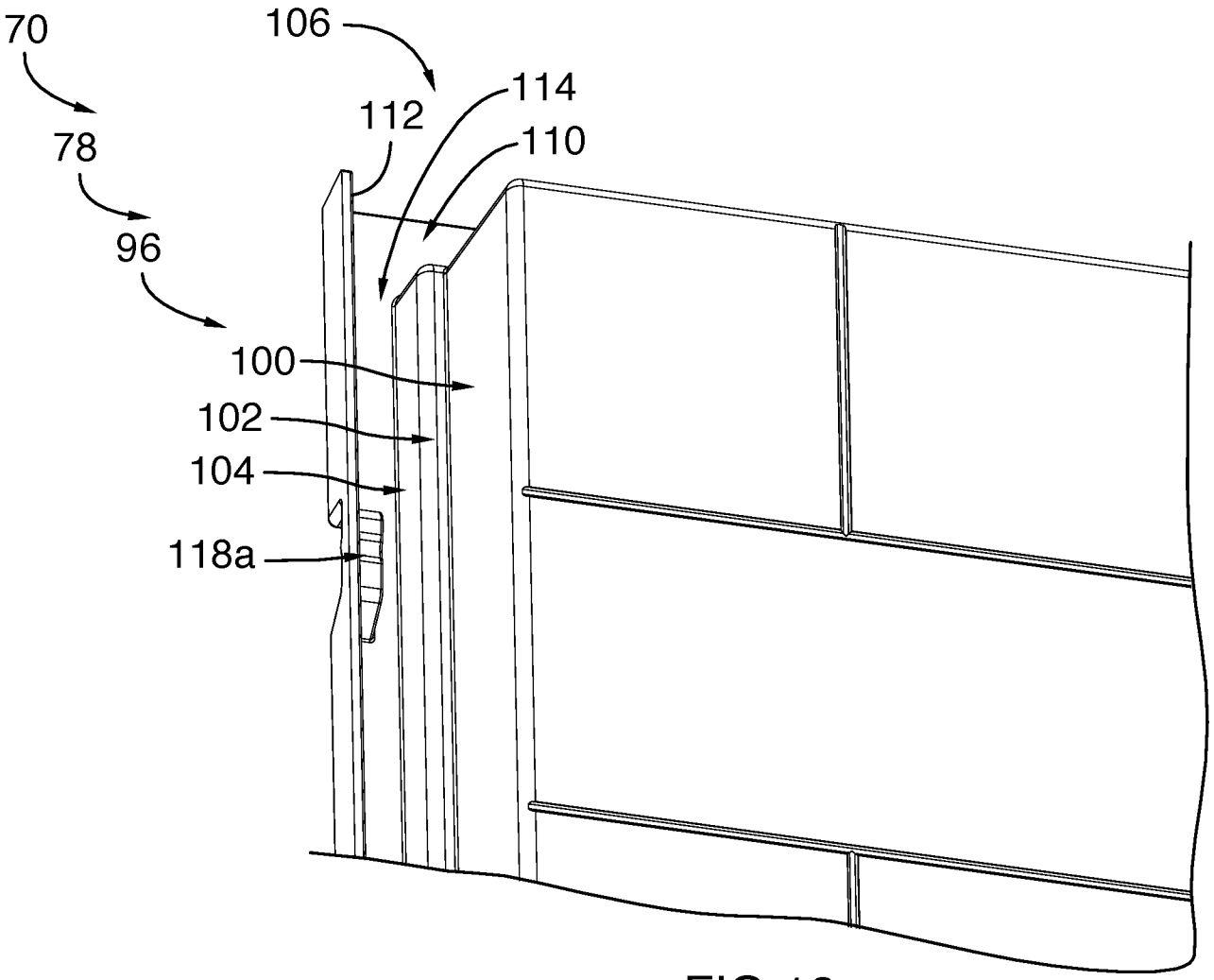
FIG. 18 is a partial enlarged back perspective view of the upper backwall panel shown in FIG. 14, also for better showing the second interlockable portion of the interlockable connecting assembly.
Figure 19:
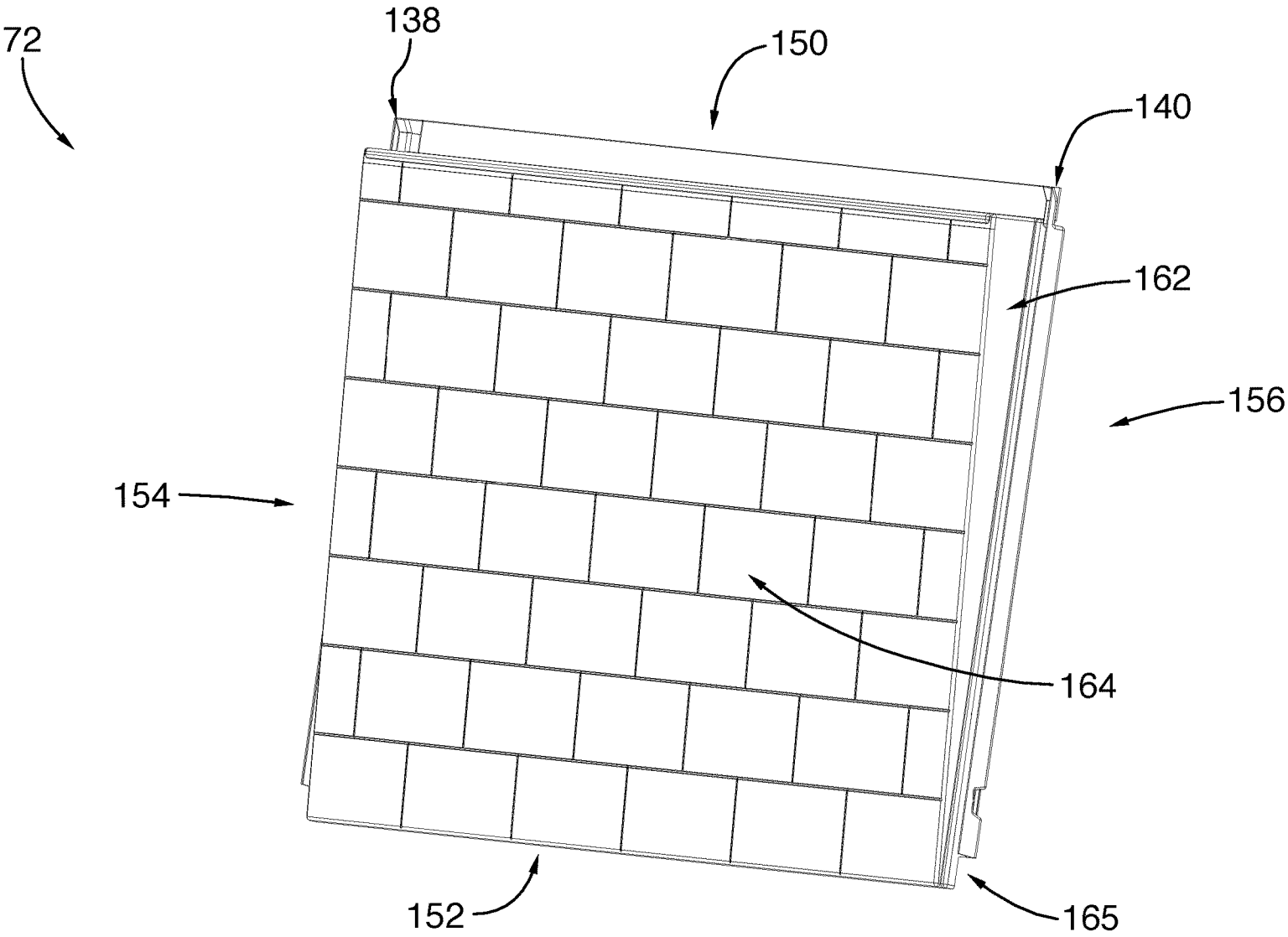
FIG. 19 is a front perspective view of a lower backwall panel of the kit of decorative wall panels shown in FIG. 1, in accordance with an embodiment.
Figure 20:
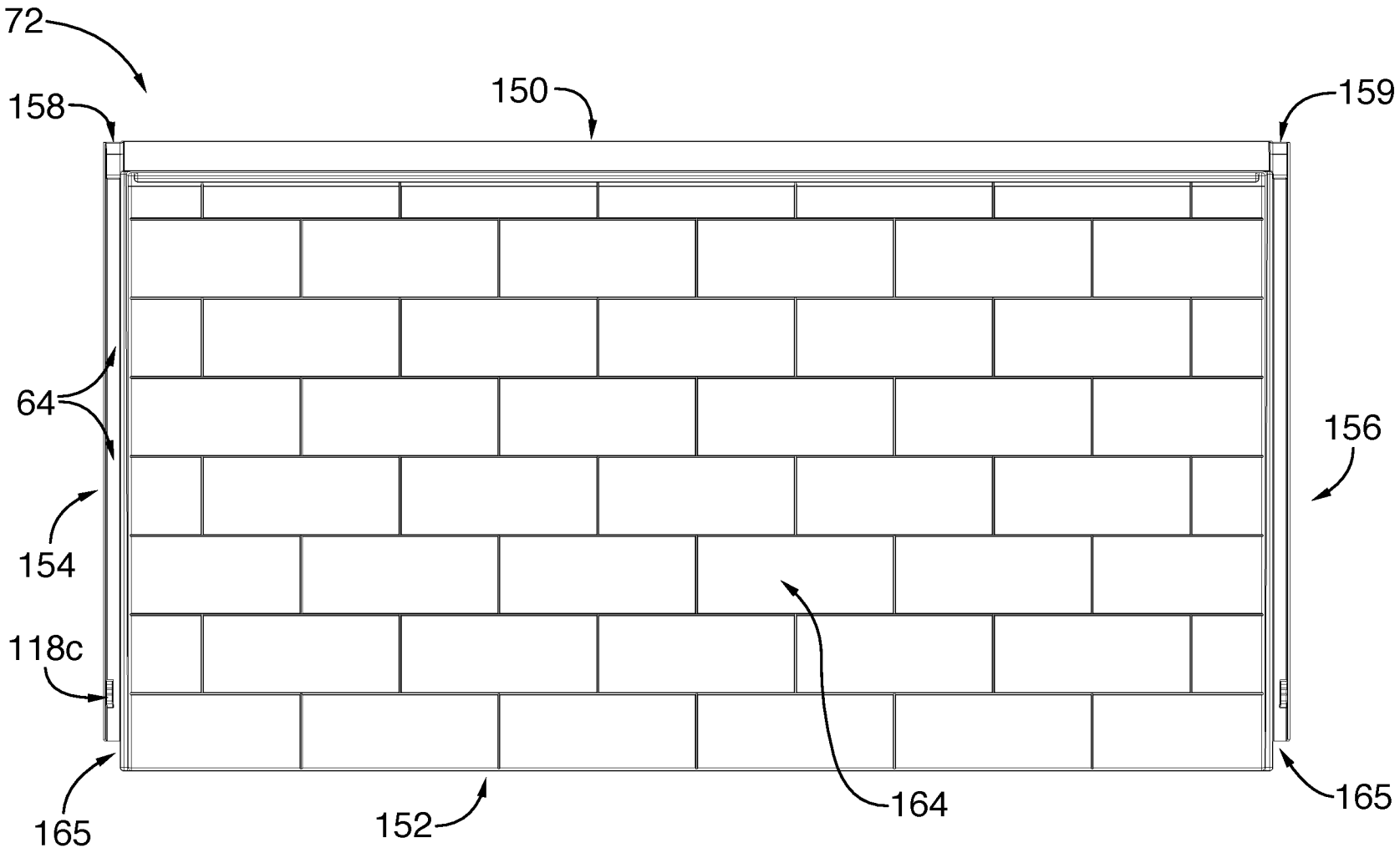
FIG. 20 is a front view of the lower backwall panel shown in FIG. 19.
Figure 21:
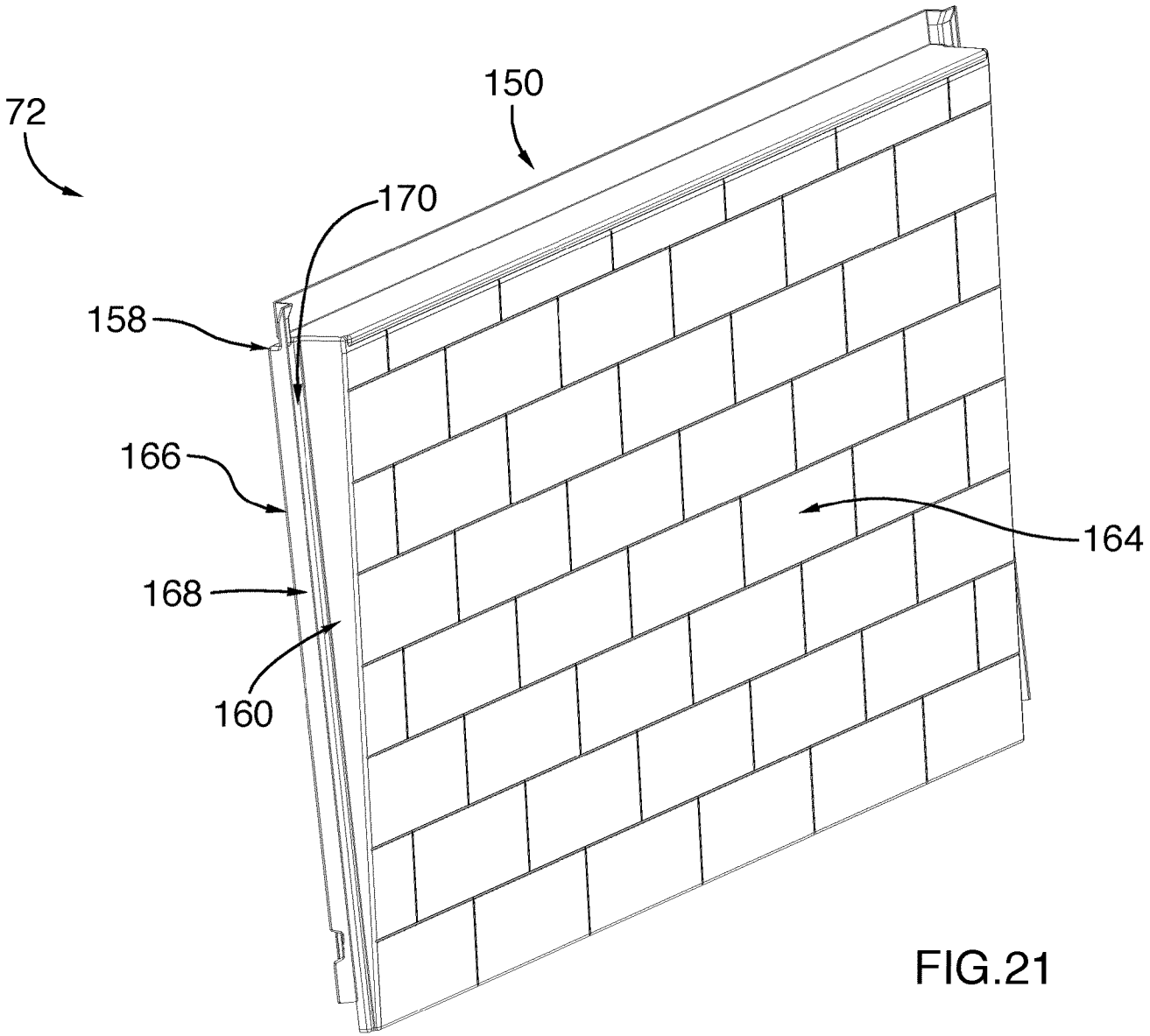
FIG. 21 is an enlarged side perspective view of the lower backwall panel shown in FIG. 19.

Extending between the left and right peripheral walls 96, 98 are the top and lower peripheral walls 92, 94 (best shown in FIGS. 14, 16 and 17). The top peripheral wall 92 includes a generally flat portion 120 extending backwardly and generally perpendicularly relative to the plane of the backwall panel 14. Extending perpendicularly from the top peripheral wall 92 is a generally flat flange 124. Like top flange 40 and left flange 42 of sidewall panel 12*a*, flange 124 can be used to secure the upper backwall portion 70 to the bathroom wall using glue, screws, nails or any other type of suitable fasteners (not shown). The person skilled in the art will understand that any other suitable securing means can also be used.

The lower peripheral wall 94 includes a generally flat portion 130 extending backwardly and perpendicularly relative to the plane of the backwall panel 14, and a lip 132, extending downwardly and forming part of the frame 88 of the niche portion 86. Lip 132 (best shown in FIG. 17,) is configured to overlap the top end of the lower backwall panel 72 when the decorative wall panels kit is assembled.

Provided at the lower end 76 of the upper backwall panel 70 is a pair of pegs 134, 136 (best shown in FIG. 14), which are receivable in a corresponding pair of pockets 138, 140 on the lower backwall panel 72 (best shown in FIG. 19), as it will become apparent below.

Figure 22:
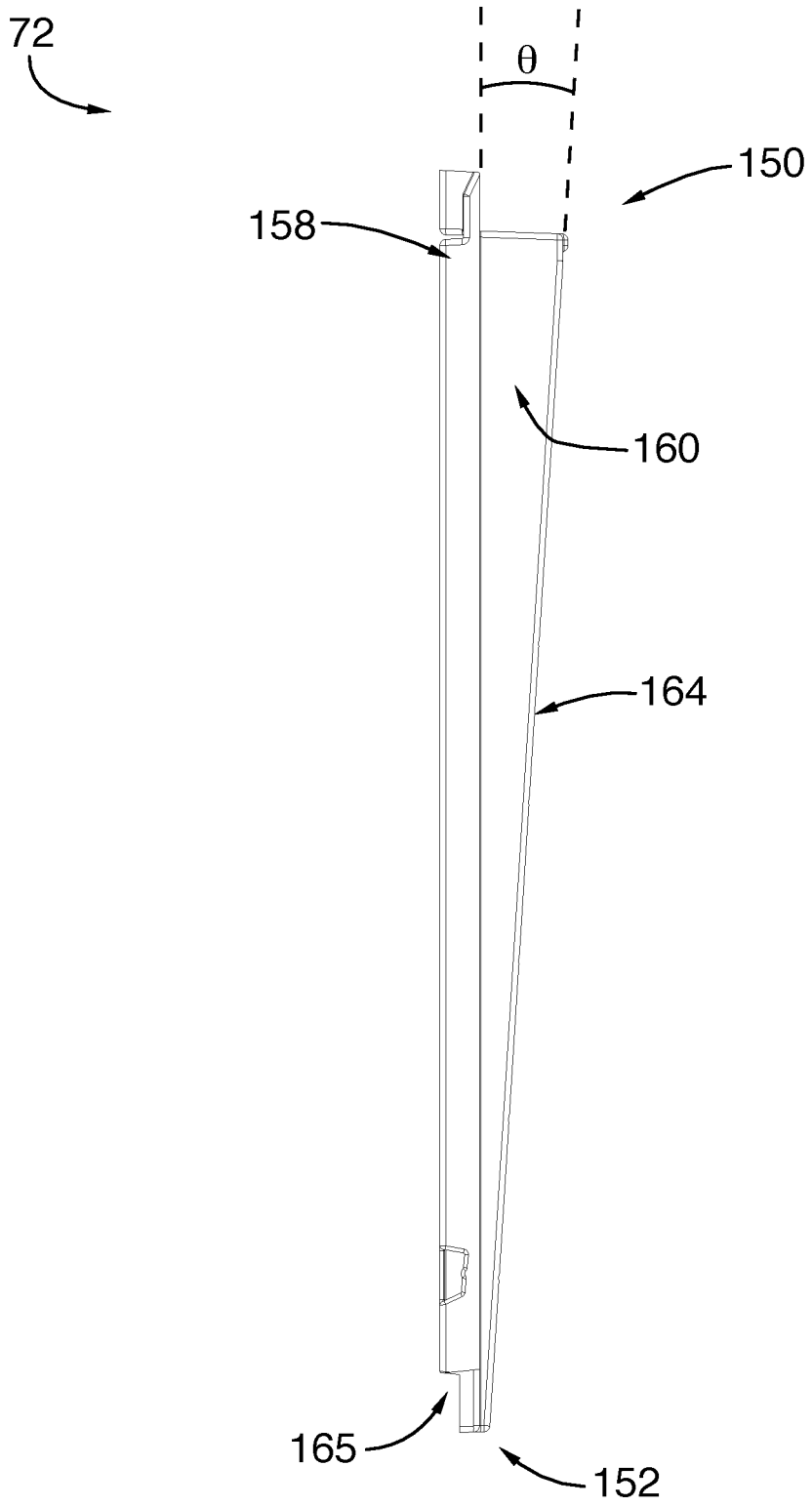
FIG. 22 is a left side view of the lower backwall shown in FIG. 19.
Figure 23:
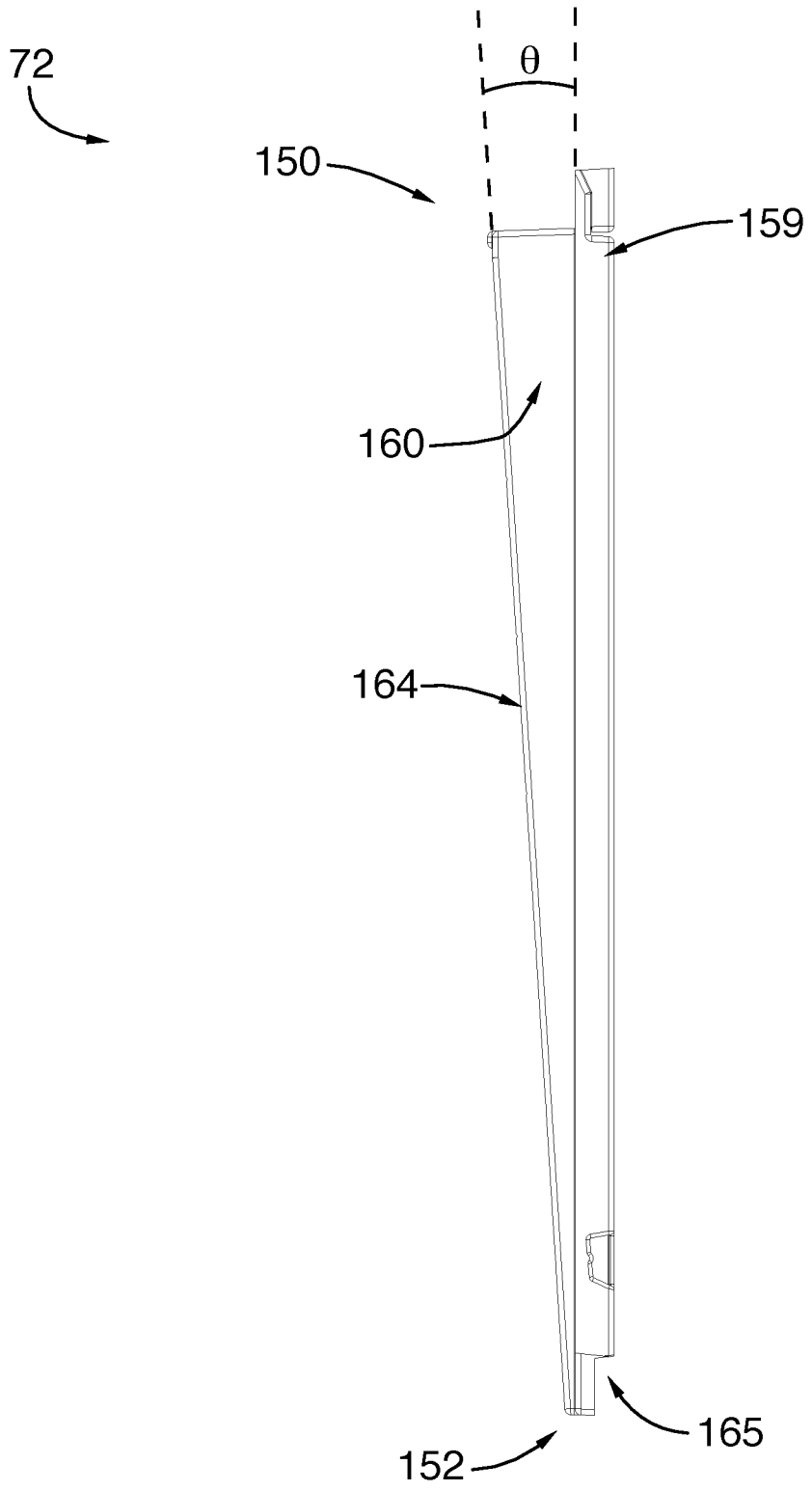
FIG. 23 is right side view of the lower backwall shown in FIG. 19.

With reference to FIGS. 19 to 25, the lower backwall panel 72 will now be described. Lower backwall panel 72 comprises a top end 150 adjacent to the lower end 94 of the upper backwall panel 70, a lower end 152 adjacent to a shower or bath tub base, a left end 154 adjacent to the right end 26 of the sidewall panel 12*a*, and a right end 156 adjacent to the corresponding end of the sidewall 12*b* when the kit 10 is assembled to define an enclosure. At the left and right ends 154, 156 are generally triangular side walls 160, 162, which taper from the top end 150 toward the lower end 152, as well as a front wall 164 extending between the two triangular side walls 160, 162. Because of the shape of the triangular side walls 160, 162, front wall 164 extends at an angle θ relative to the vertical. As best shown in FIGS. 22 and 23, the triangular side walls 160, 162 are configured such that the angle θ allows a smooth transition from the thickness of the niche portion 86 of the upper backwall panel 70 to a flange extending upwardly from the periphery of the bath tub or shower base (not shown). In other words, the distance separating the wall or the studs of the room and the front panel 164 of the lower backwall panel 72 is greater at the top end 150 and gradually reduces toward the lower end 152.

A notch 165 is defined along the length of the lower end 152 of the lower backwall panel 72. This notch 165 allows overlapping the lower end 152 of the lower backwall panel 72 over a flange typically extending vertically from the shower base or bath tub to prevent water leakage (not shown). As it will be apparent to the person skilled in the art, a silicon or caulking joint can also be applied at the junction of the shower base or bath tub and the lower end 152 of the lower backwall panel 72 to further prevent water leakage (not shown).

Left and right L-shaped flanges 158, 159 extend from each triangular side walls 160, 162. Since left and right L-shaped flanges 158, 159 are mirror images of one another, only left L-shaped flange 158 will be described. The person skilled in the art will understand that a similar description also applies to right L-shaped flange 159. Left L-shaped flange 158 comprises a first portion 166 extending in a plane generally parallel to the plane of the backwall panel 14, and a second portion 168 extending perpendicular to the first portion 166. Together with the triangular wall 160, the first and second portions 166, 168 of the left L-shaped flange 158 define a recess 170 for receiving the right end 26 of the left sidewall panel 12*a* in alignment with the recess 114 of the of the upper backwall panel 70. Defined in the recess 170 is the second interlockable portion 64 of the interlockable connecting assembly 16. The second interlockable portion 64 comprises a vertically spaced-apart pocket portion 118*c* integrally molded with the lower backwall panel 72. As for each of the pocket portions 118*a*-118*b* of the upper backwall panel 70, the pocket portion 118*c* is open on a vertical inner side at the top so that the pocket portion 118*c* can receive the corresponding dowel 66*c* of the first interlockable portion 62 of the left sidewall panel 12*a*. The second portion 168 of the left L-shaped flange is received in the notch 60 of the left sidewall panel 12*a*.

In the illustrated embodiment, the decorative wall panels are assembled on a shower base or bath tub and secured to drywall or concrete walls adjacent to a shower base or bath tub. The lower and upper backwall panels 72, 70 are first mounted and secured to form the backwall panel 14. Then, the first interlockable portion 62 of sidewall panel 12*a* is mounted into the second interlockable portion 64 of backwall panel 14 and the corresponding first interlockable portion 62 of sidewall panel 12*b* is mounted into the corresponding second interlockable portion 64 of backwall panel 14. The sidewall panels 12*a*, 12*b* are then secured to the drywall or concrete walls.

The sidewall panel 12*a* being the mirror image of the sidewall panel 12*b*, only the assembling of sidewall panel 12*a* will be described. The person skilled in the art will understand that a similar description applies to assemble sidewall panel 12*b* to backwall panel 14 with proper modifications. To assemble the backwall panel 14, the upper backwall panel 70 is positioned so that the pair of pegs 134, 136 are aligned above the corresponding pair of pockets 138, 140 of the lower backwall panel 72, while the lower peripheral wall 94 of the upper backwall panel is aligned above the top end 150 of the lower backwall panel 72.

Figure 24:
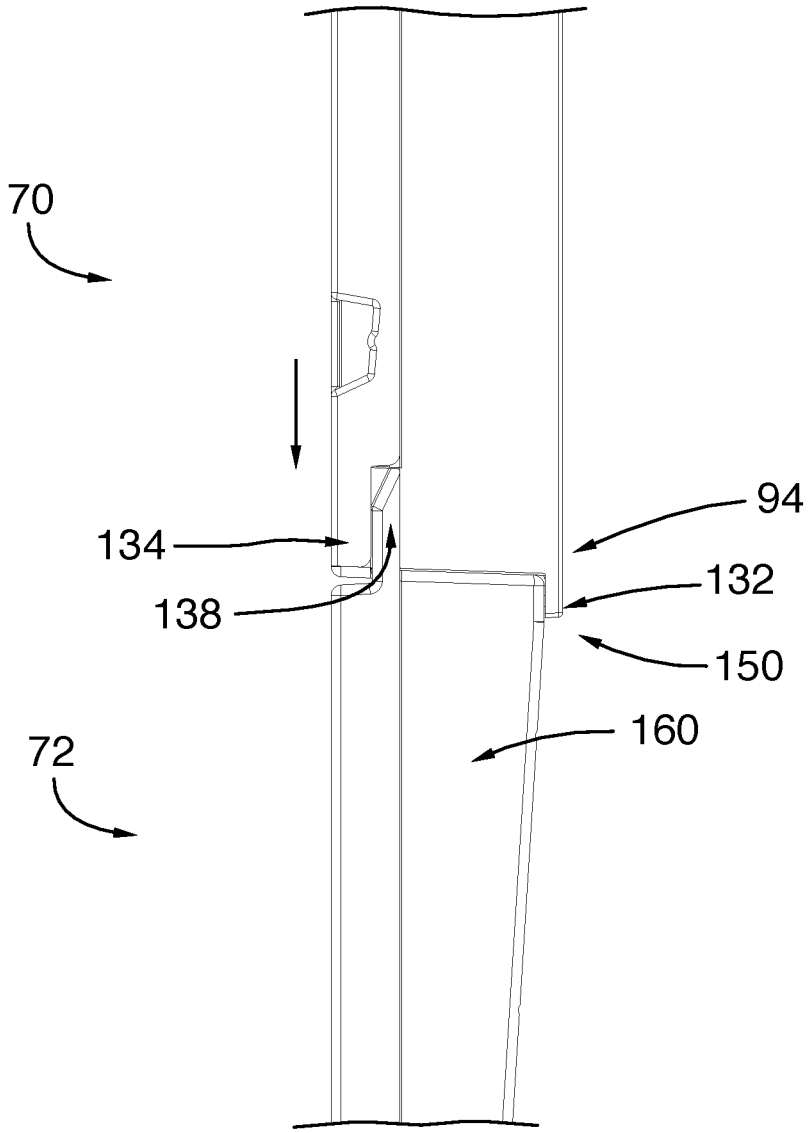
FIG. 24 is an enlarged, partial side view of the lower backwall panel and the upper backwall panel of the kit of decorative wall panels shown in FIG. 1, assembled to one another.
Figure 25:
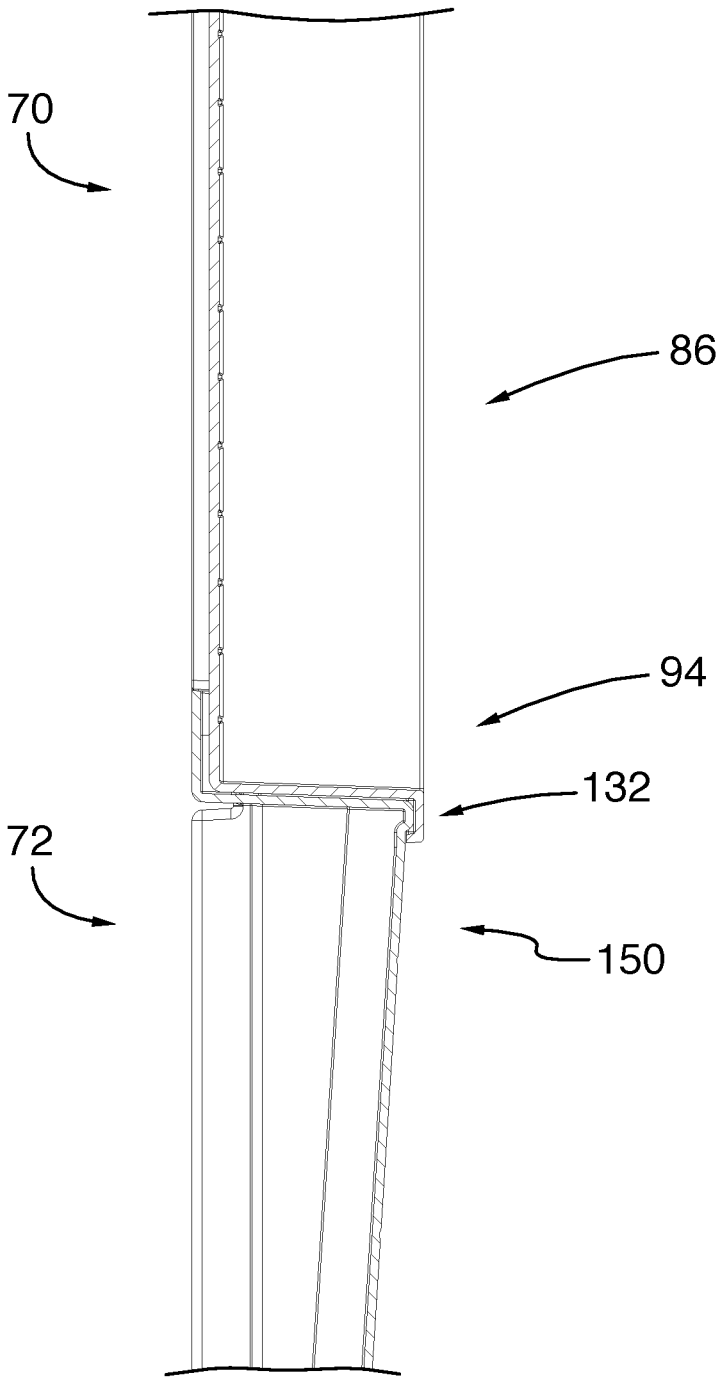
FIG. 25 is a side cross-section view of the lower backwall panel and the upper backwall panel of the kit of decorative wall panels shown in FIG. 1, assembled to one another.
Figure 26:
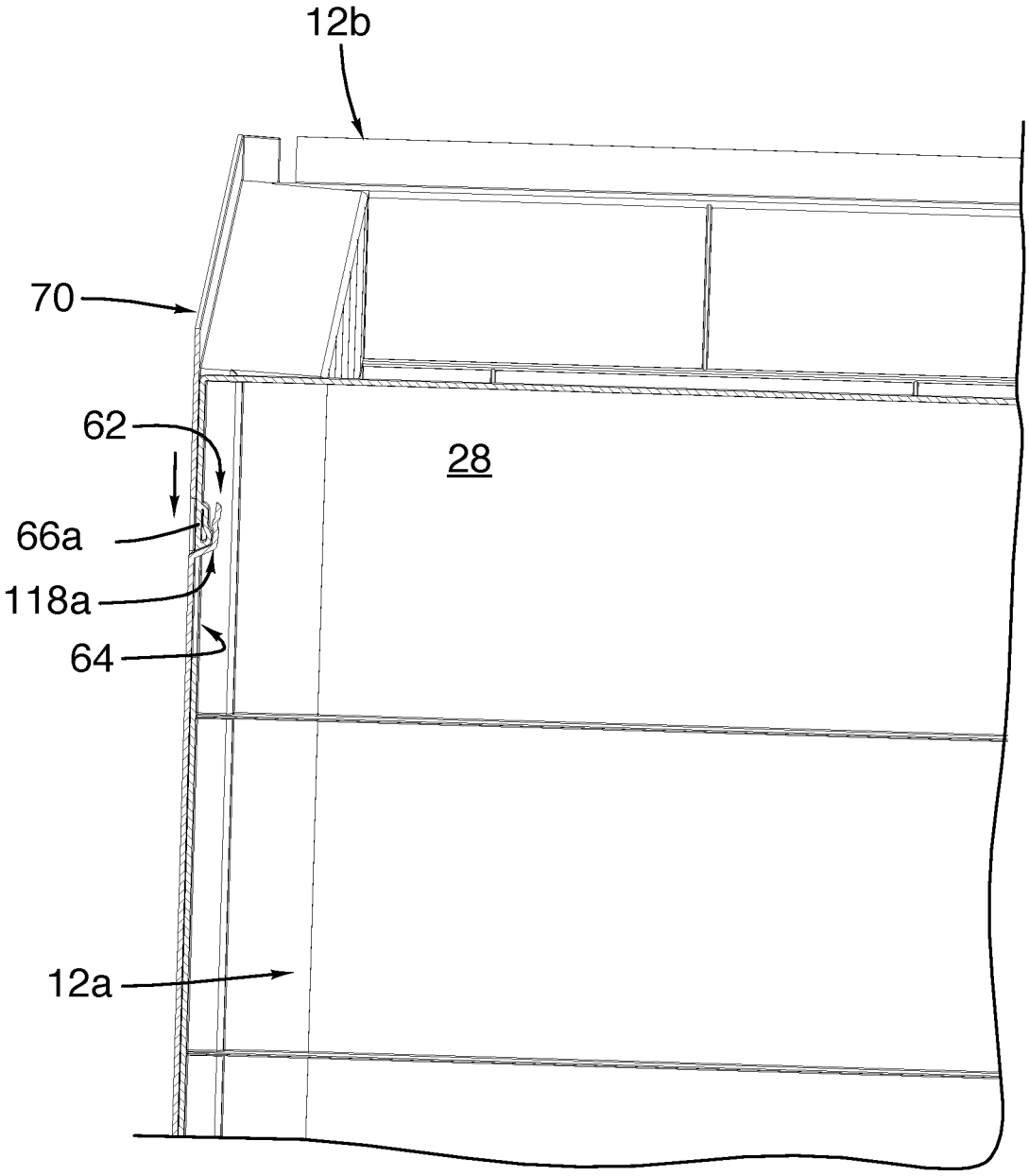
FIG. 26 is an enlarged, partial view of the sidewall panel and the backwall panel of the kit of decorative wall panels shown in FIG. 1 showing the engagement action between a dowel of the first interlockable portion and a corresponding pocket of the second interlockable portion of the interlockable connecting assembly.

As best seen in FIG. 24, upon downward vertical movement of the upper backwall panel 70 relative to the lower backwall panel 72, peg 134 engages its corresponding pockets 138 of the lower backwall panel 72 and the lower peripheral wall 94 of the upper backwall panel contacts the top end 150 of the lower backwall panel 72. In the same way, upon downward vertical movement of the upper and lower backwall panels 70, 72, peg 136 engages its corresponding pockets 140 of the lower backwall panel 72 and the lower peripheral wall 94 of the upper backwall panel contacts the top end 150 of the lower backwall panel 72. To assemble the sidewall panel 12*a* to the backwall panel 14, the sidewall panel 12*a* is positioned so that the right end 26 of the left sidewall panel 12*a* is received into the recess 114 of the backwall panel 14 and each dowel 66*a*-66*c* is above its corresponding pocket portion 118*a*-118*c*. As best shown in FIG. 26, upon downward vertical movement of the sidewall panel 12*a* relative to the backwall panel 14, the dowel 66*a* engages its corresponding pocket portion 118*a*. In the same way, upon downward vertical movement of the sidewall panel 12*a* relative to the backwall panel 14, the dowel 66*b*-*c* engage their corresponding pocket portions 118*b*-*c*, thereby securing the sidewall panel 12*a* to the backwall panel 14.

Figure 27:
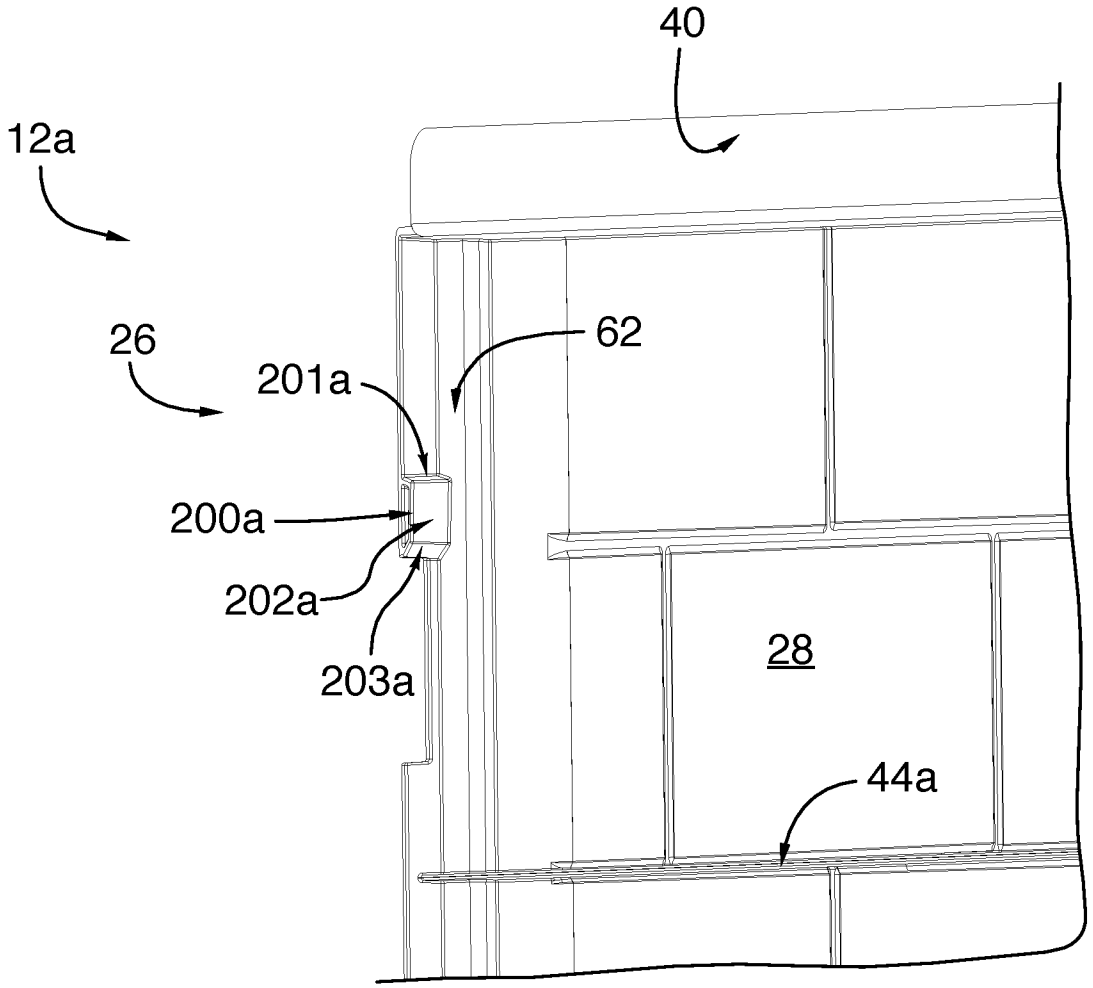
FIG. 27 is an enlarged partial perspective view of the sidewall panel shown in FIG. 7 but with an alternative embodiment of a dowel.
Figure 28:
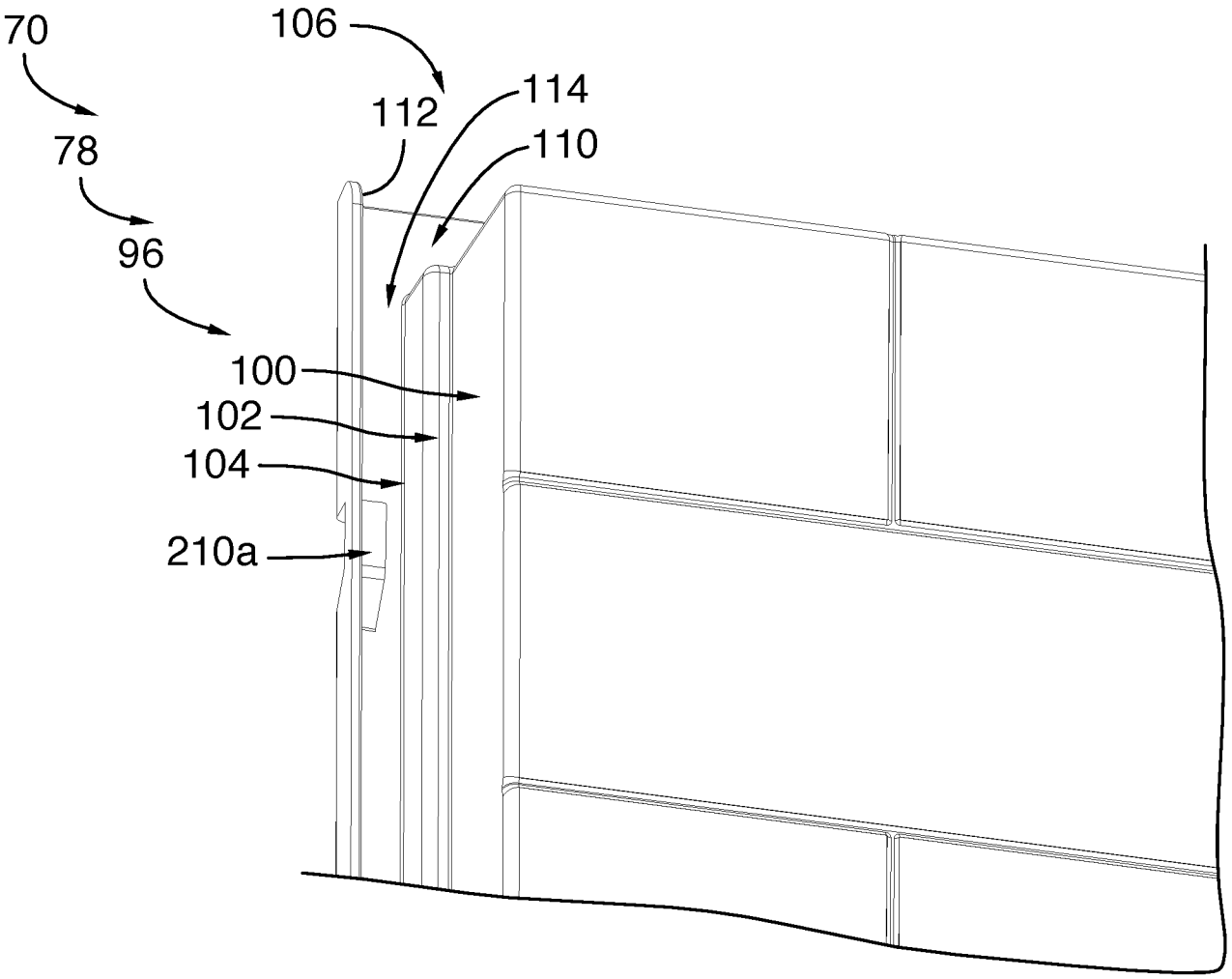
FIG. 28 is a partial enlarged back perspective view of the upper backwall panel shown in FIG. 14 but with an alternative embodiment of a pocket.
Figure 29:
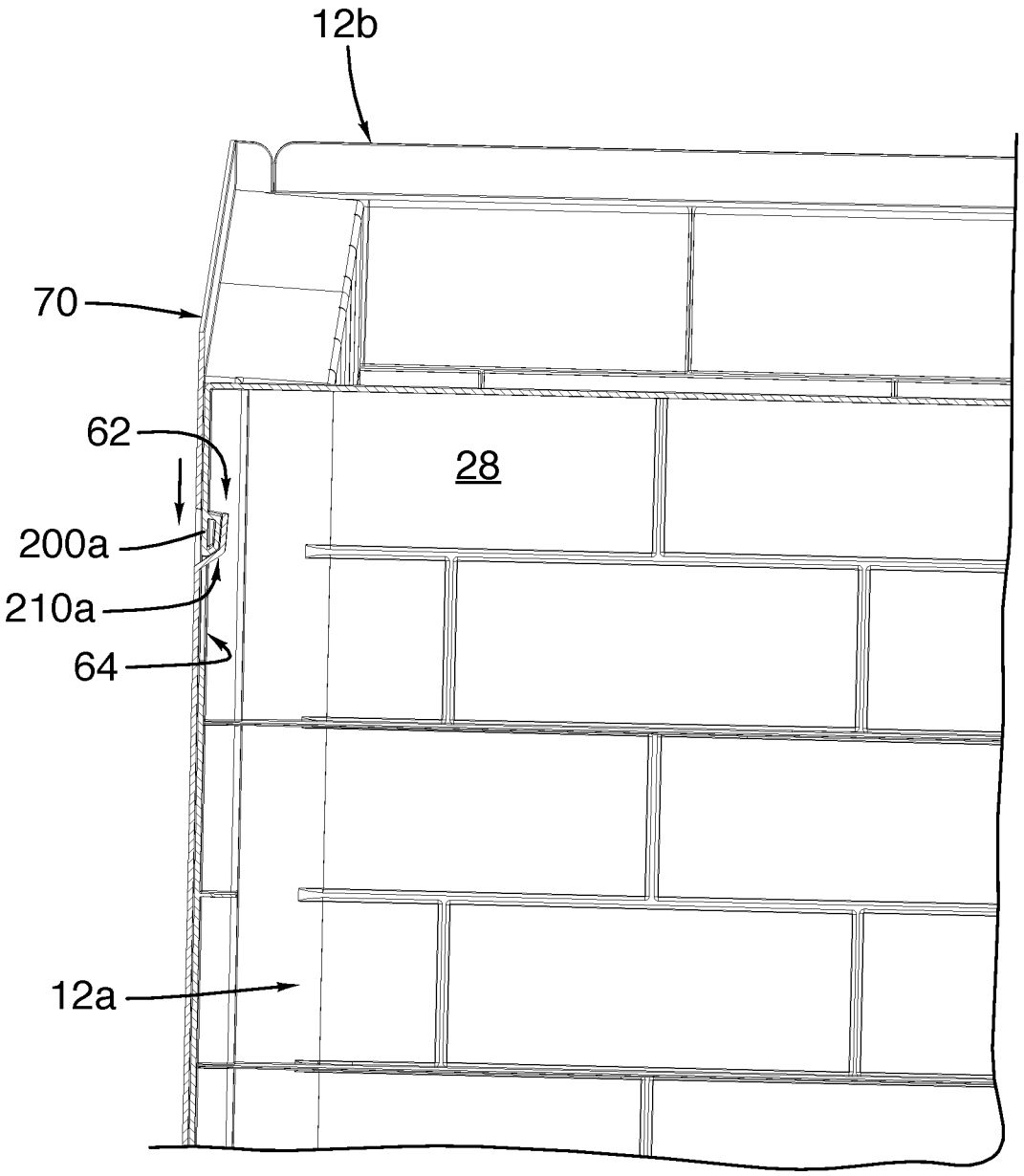
FIG. 29 is an enlarged, partial view of the sidewall panel and the backwall panel of the kit of decorative wall panels shown in FIG. 1 showing the engagement action between an alternative embodiment of a dowel and pocket.

While in the above embodiments the dowels 66*a*-66*c* had a curvature with the corresponding pocket portions 118*a*-118*c* designed to accommodate such a curvature, it is envisaged that alternative configurations or shapes of the interlockable connecting assembly are possible without deviating from the scope of the invention. For instance, FIGS. 27 and 28 illustrate another embodiment of the invention including the dowel 200*a* and corresponding pocket 210*a* whereby the pocket facing side of the dowel 200*a* is formed of three straight surfaces (201*a*, 202*a*, 203*a*), with the pocket 210*a* shaped to engage the three straight surfaces accordingly. FIG. 29 further illustrates the locking assembly similar to FIG. 26, whereby downward vertical movement of the sidewall panel 12*a* relative to the backwall panel 14 results in engagement of the dowel 200*a* with the corresponding pocket 210*a*.

Figure 30:
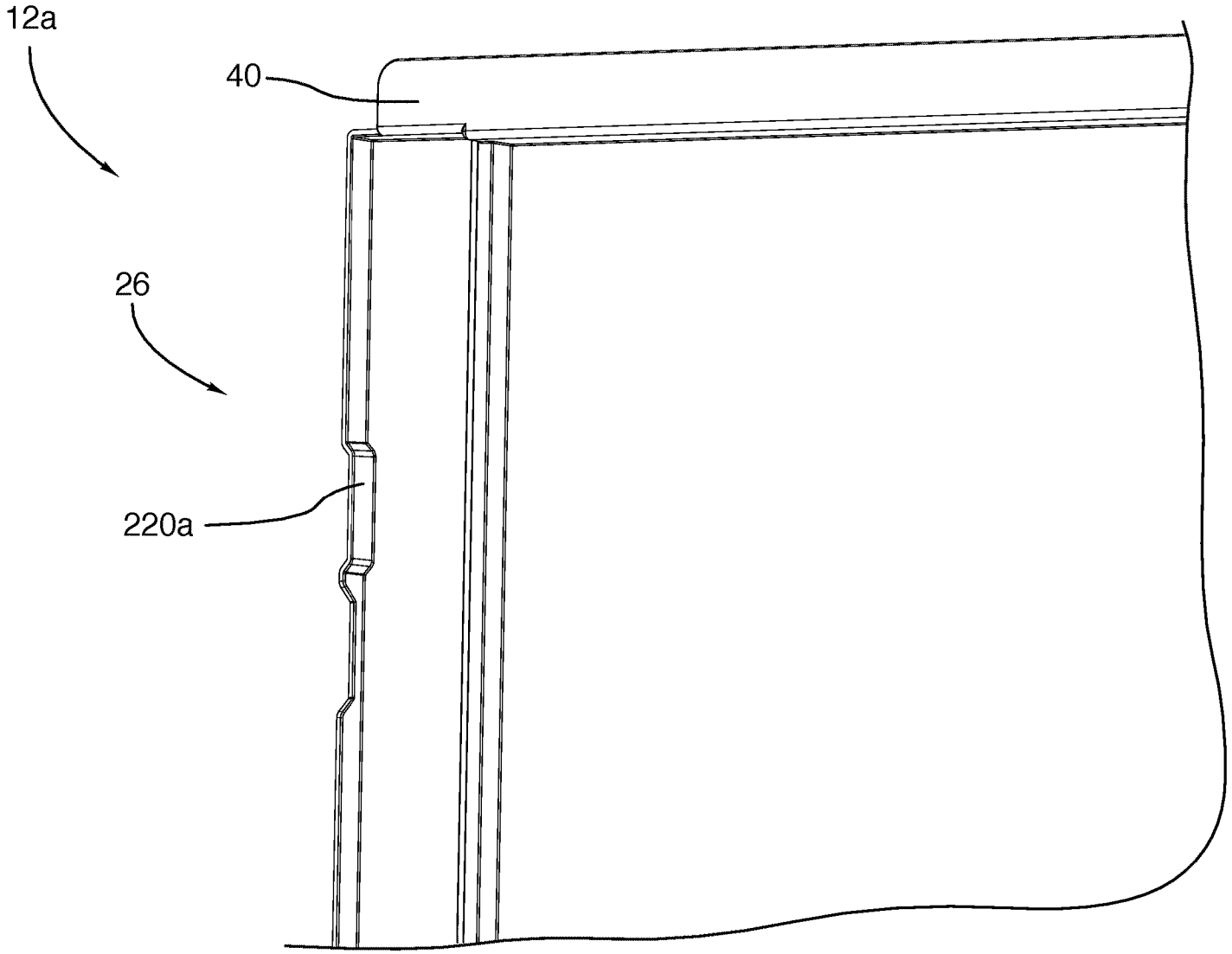
FIG. 30 is an enlarged partial perspective view of the sidewall panel shown in FIG. 7 but with an alternative embodiment of a dowel.
Figure 31:
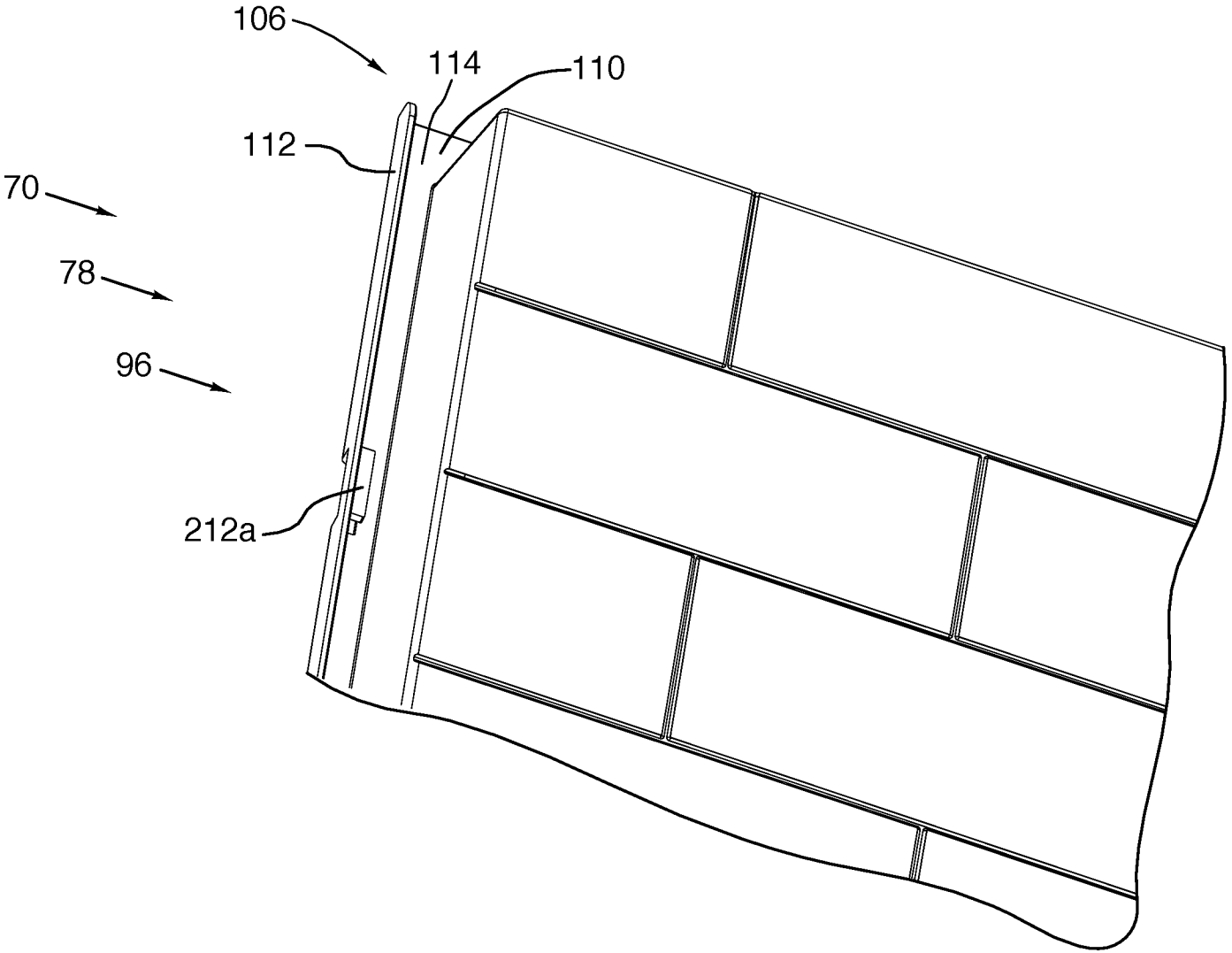
FIG. 31 is s a partial enlarged back perspective view of the upper backwall panel shown in FIG. 14 but with an alternative embodiment of a pocket.
Figure 32:
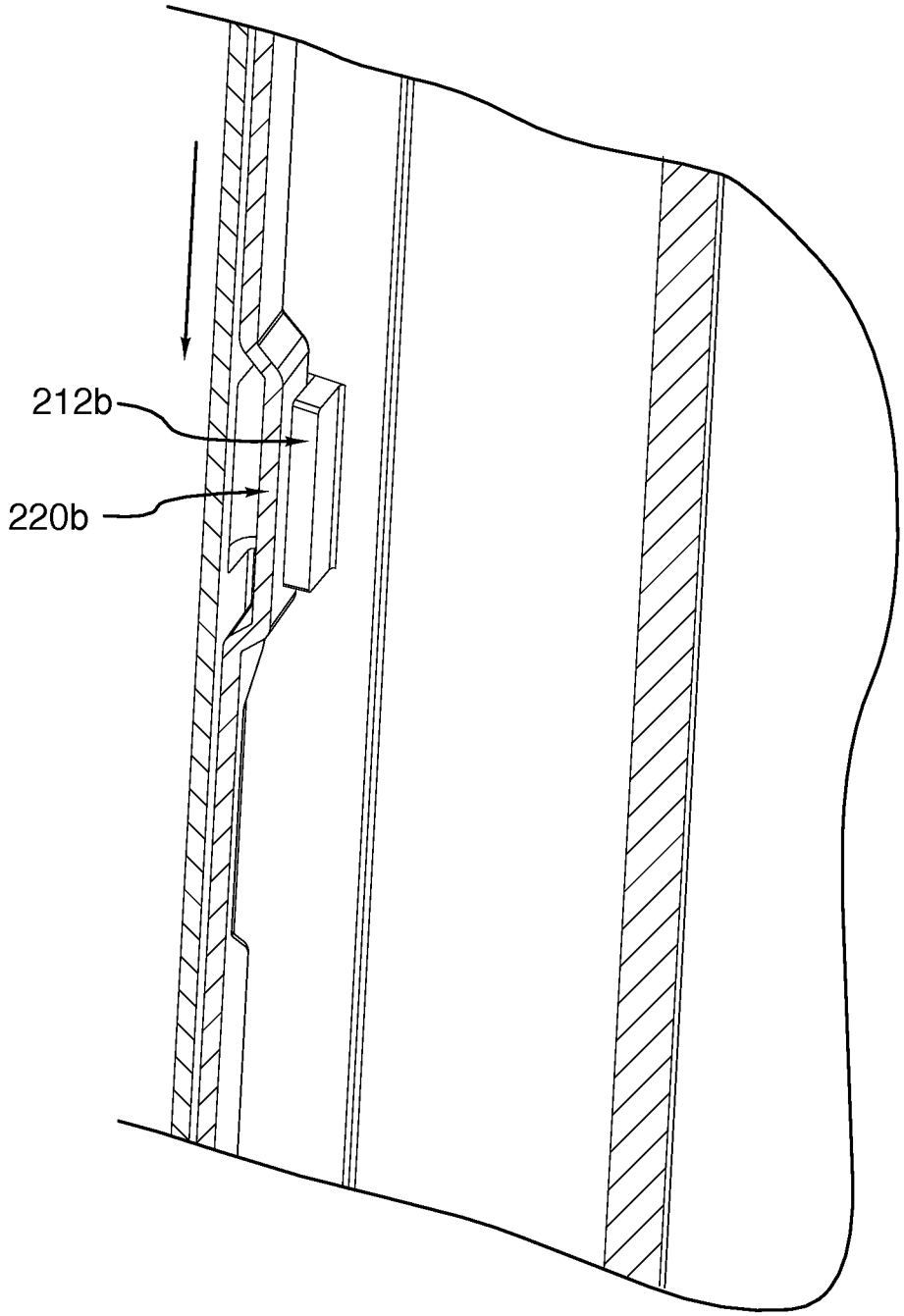
FIG. 32 is a cross-sectional view of the assembly of the alternative embodiments of the pocket and dowel of FIGS. 30 and 31 but on the right wall, displaying the locking mechanism.

With reference to FIGS. 30 to 32, another embodiment of the invention including a dowel 220*a* and 220*b*, and pocket 212*a* and 212*b*, is provided. In this embodiment, the dowel 220*a* is formed as part of the right end 26 of the side wall panel 12*a*. The pocket 212*a* is formed as part of the left end 78 of the upper backwall panel 70. The dowel 220*a* and pocket 212*a* are assembled similar to previously described dowels 66*a* and 200*a*, and pockets 118*a* and 210*a* with the difference that the pocket 212*a* does not prevent downward vertical motion of the dowel 220*a* due to lack of a lower boundary wall. The pocket 212*a* engages the dowel 220*a* by preventing motion in the two planes parallel to the face of the upper backwall panel 70 and the face of the sidewall panel 12*a*. A cross sectional view is provided in FIG. 32 displaying this mechanism when the sidewall panel 12*b* is assembled with the right end 80 of the upper backwall panel 70, where the pocket 212*b* engages the dowel 220*b*.

Furthermore, in the illustrated embodiments, the sidewall panels 12*a*, 12*b* and backwall panel 14 have a faux-tile pattern defined on their front faces to provide aesthetic properties to the shower or bath tub enclosure. The person skilled in the art will appreciate that any other pattern may be suitable. To define the faux-tile pattern, grout line imitations are defined horizontally and vertically on the sidewall panels 12*a*, 12*b*, e.g. vertical grout lines 180*a*, 180*b* and horizontal grout lines 182*a*, 182*b*, and on the backwall panel 14, including the upper and lower backwall panel 70, 72, e.g. vertical grout lines 184*a*, 184*b* and horizontal grout lines 186*a*, 186*b* (best shown in FIG. 3). While in the illustrated embodiment, the niche portion 86 comprises a first type of faux-tile pattern and the remainder of the sidewall panels 12*a*, 12*b* and backwall panel 14 comprise a second type of faux-tile pattern, the person skilled in the art will appreciate that numerous faux-tile patterns are possible and that other symmetrical, asymmetrical, and combinations thereof are also possible. To the contrary, the person skilled in the art will understand that the present invention can be worked out without the presence of any pattern.

Figure 3:
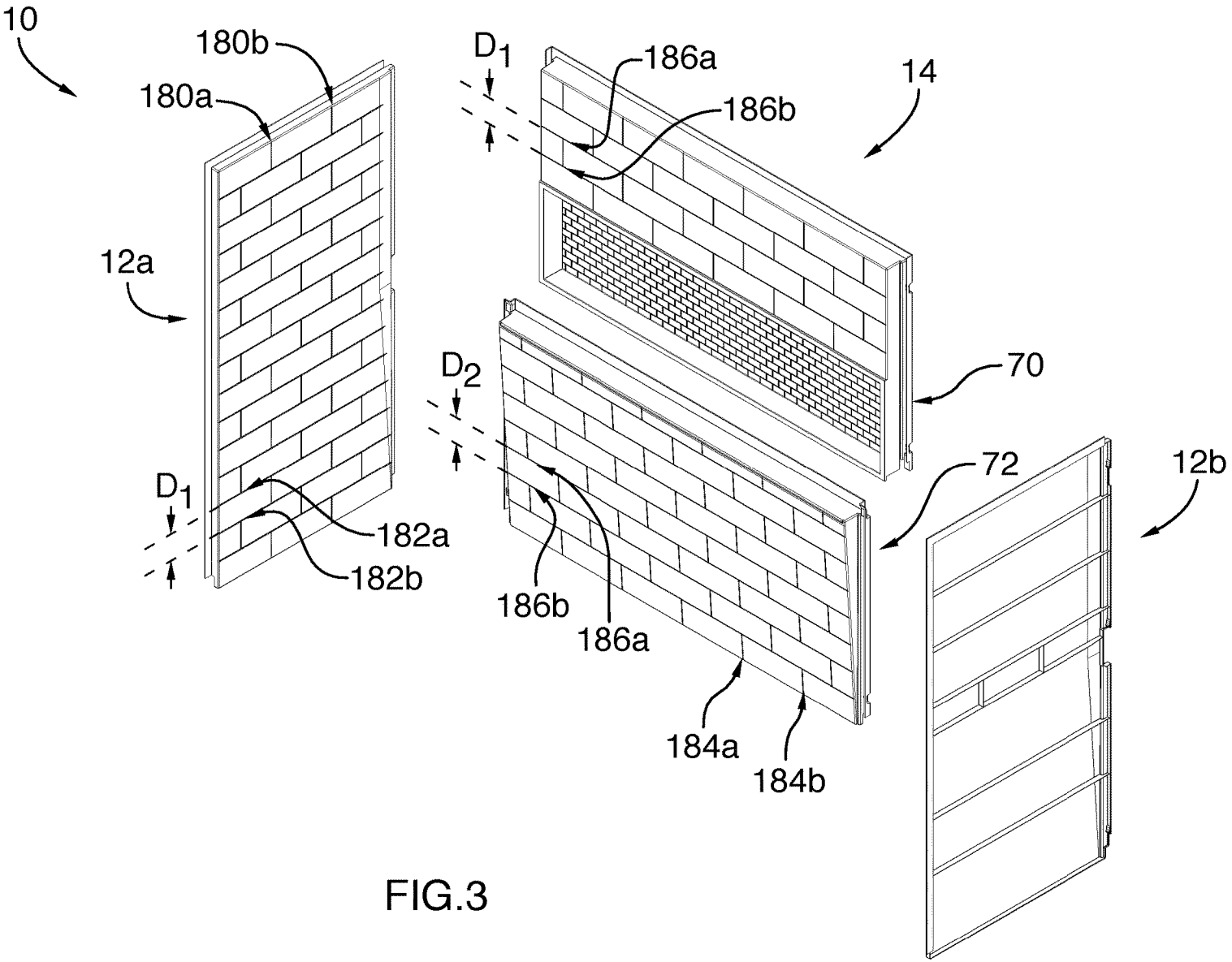
FIG. 3 is a front right perspective, exploded view of the kit of decorative wall panels shown in FIG. 1.
Figure 4:
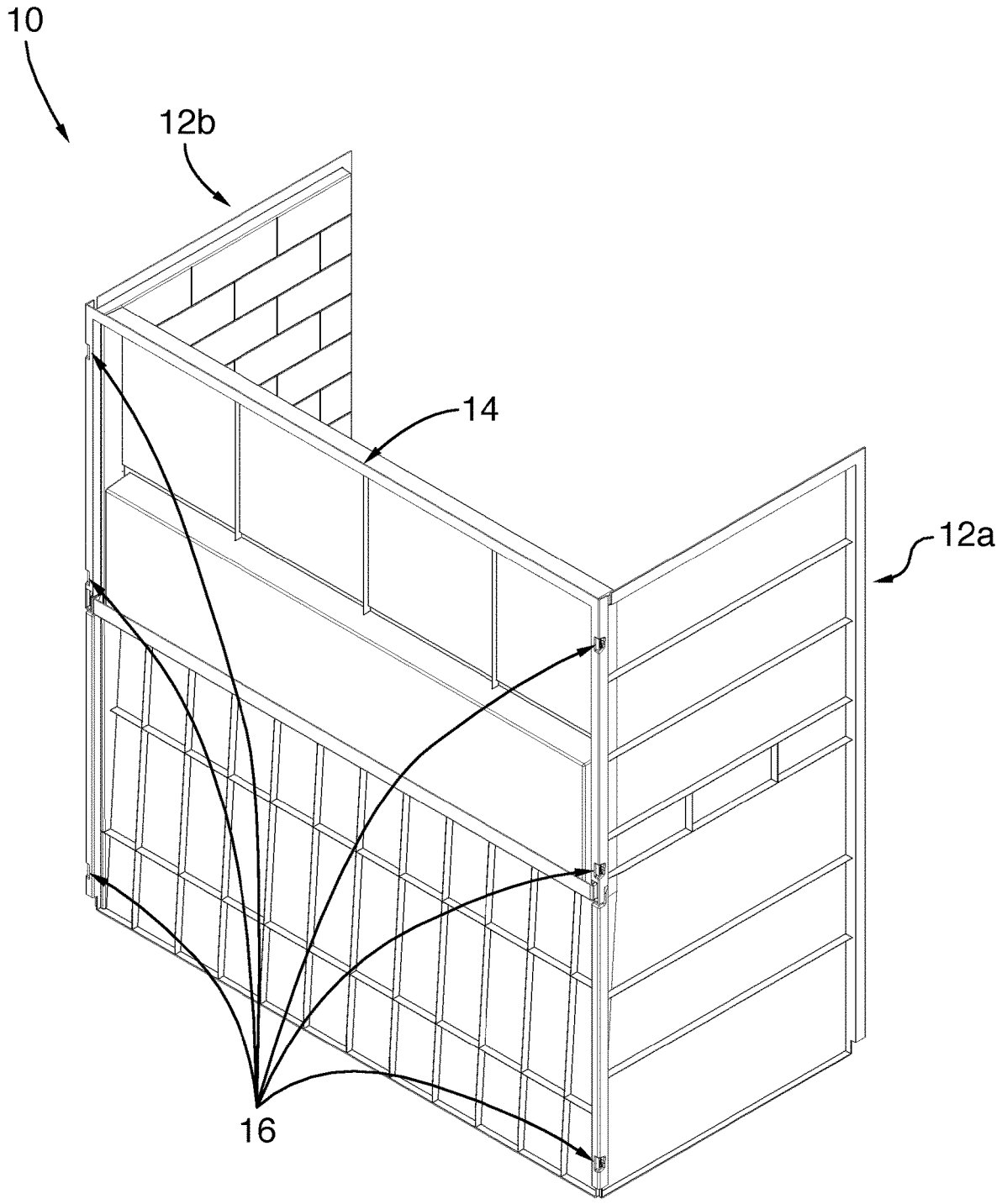
FIG. 4 is a back left perspective view of the kit of decorative wall panels shown in FIG. 1.
Figure 5:
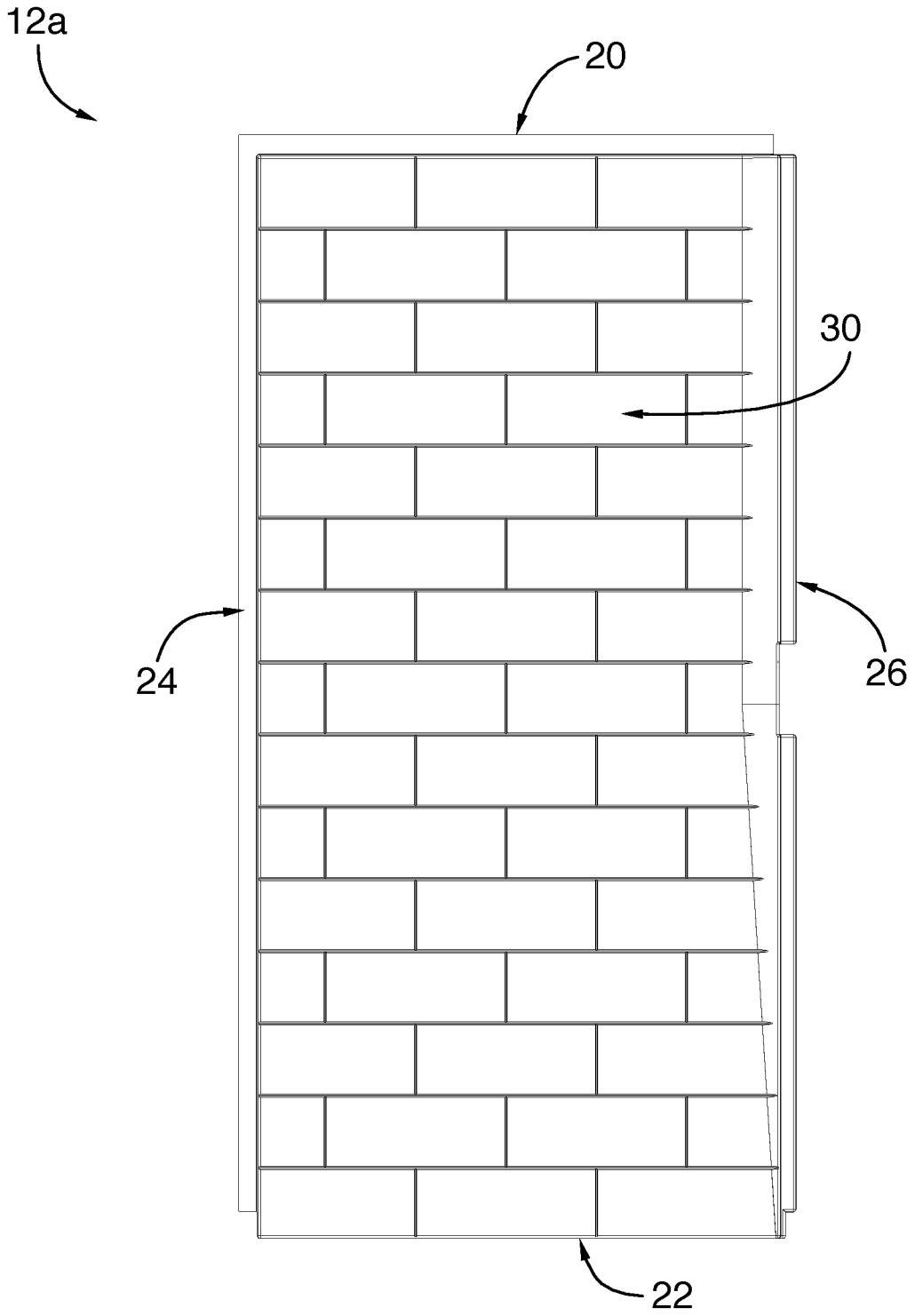
FIG. 5 is a front elevation view of a right sidewall panel of the kit of decorative wall panels shown in FIG. 1, in accordance with an embodiment.

The horizontal grout lines of the faux-tile pattern of sidewall panels 12*a*, 12*b* (e.g. horizontal grout lines 182*a*, 182*b*), as well as the horizontal grout lines of upper backwall 70 of backwall panel 14 (e.g. horizontal grout lines 186*a*, 186*b*) are separated by a first distance $D_1$ (see FIG. 3). Because the lower backwall panel 72 defines an inclined plane resulting in an inclination of the lower portion of backwall panel 14 at an angle θ relative to the vertical, the horizontal grout lines (e.g. horizontal grout lines 186*a*, 186*b*) of the lower portion of the backwall panel 14 are separated by a distance $D_2$ slightly greater than distance $D_1$ and adapted to permit the alignment of the horizontal grout lines of the backwall panel 14 (e.g. horizontal grout lines 186*a*, 186*b*) with those of the sidewall panels 12*a*, 12*b* (e.g. horizontal grout lines 182*a*, 182*b*). As such, the continuity of the horizontal grout lines across the backwall panel 14 and sidewall panels 12*a*, 12*b* creates a visual perception that the lower portion 72 of the backwall panel 14 is vertically extending, thus allowing for making use of relief elements such as a niche even with the use of symmetrical patterns such as faux-tile patterns.

While in the above-described embodiment the sidewall panels 12*a* and 12*b* were described as single pieces, the person skilled in the art will understand that such sidewall panels 12*a* or 12*b* can be made either of a single piece or alternatively from several components attached or connected to one another. Likewise, while the various components of backwall panel 14 were also described as unitary components, the person skilled in the art will understand that these components can themselves be made of several connectable pieces. The person skilled in the art will also appreciate that the backwall panel 14 can be connectable to any one of sidewall panels 12*a*, 12*b* to produce different configurations of shower and/or bath tub enclosures, and that more or less wall panels having various configurations can be used to create various enclosure configurations. For instance, the person skilled in the art will further appreciate that the backwall panel 14 can be used independently of the sidewall panels 12*a*, 12*b* to create a niche or any other type of relief element as described herein. In this regard, the term "relief element" as intended herein should be interpreted broadly to include niches, alcoves, shelves and any other type of relief element, whether projecting frontwardly from the front face of the wall panel, or backwardly therefrom.

The embodiments of the invention described above are intended to be exemplary only. The scope of the invention is therefore intended to be limited solely by the scope of the appended claims.

We claim:

1. A kit of decorative wall panels, comprising:

a first wall panel including:

a top end, a bottom end, a front face extending from the top end to the bottom end, the front face defining a first decorative pattern, a back face disposed on the first wall panel opposite of the front face, a relief element disposed on the front face, the relief element extending backwardly from the front face towards the back face, and wherein the front face of the first wall panel tapers backwardly towards the back face as the front face extends from the relief element towards the bottom end of the first wall panel;

a second wall panel including a front face, the front face of the second wall panel defining a second decorative pattern;

a third wall panel including a front face, the front face of the third wall panel defining a third decorative pattern;

a first connecting assembly configured for connecting the first wall panel to the second wall panel; and a second connecting assembly configured for connecting the third wall panel to the first wall panel or the second wall panel.

2. The kit of decorative wall panels of claim 1, wherein the kit is mountable to a shower base or a bathtub to define an enclosure.

3. The kit of decorative wall panels of claim 1, wherein the at least one relief element of the first wall panel is recessed relative to the front face of the first wall panel.

4. The kit of decorative wall panels of claim 3, wherein the recessed relief element comprises a niche.

5. The kit of decorative wall panels of claim 1, wherein the first decorative pattern of the front face of the first wall panel, the second decorative pattern of the front face of the second wall panel, and the third decorative pattern of the front face of the third wall panel define a symmetrical pattern.

6. The kit of decorative wall panels of claim 5, wherein the symmetrical pattern is a faux-tile pattern.

7. The kit of decorative wall panels of claim 1, wherein the first connecting assembly and the second connecting assembly are configured to allow removably connecting the first wall panel, the second wall panel, and the third wall panel.

8. The kit of decorative wall panels of claim 7, wherein the first connecting assembly and the second connecting assembly each comprises a plurality of dowels and a corresponding plurality of pockets for receiving the plurality of dowels.

9. A kit of decorative wall panels, comprising:

a first wall panel mountable to a structure and including:

an upper end, a lower end, a front face extending between the upper end and the lower end, a back face disposed on the first wall panel opposite of the front face and extending between the upper end and the lower end, and at least one relief element disposed on the front face, the at least one relief element being recessed relative to the front face of the first wall panel and including a rear face, the first wall panel being configured for the rear face of the at least one relief element to rest against the structure, wherein the front face tapers towards the back face as the front face extends from the at least one relief element towards the lower end of the first wall panel;

a second wall panel including a back face and a front face, the second wall panel being mountable to the structure;

a third wall panel including a back face and a front face, the third wall panel being mountable on the structure and configured for the back face of the third wall panel to abut the structure;

a first connecting assembly configured for connecting the first wall panel to the second wall panel; and a second connecting assembly configured for connecting the third wall panel to the first wall panel or the second wall panel.

10. The kit of decorative wall panels of claim 9, wherein the relief element comprises a niche.

11. The kit of decorative wall panels of claim 9, wherein the structure comprises a wall or wall studs.

12. The kit of decorative wall panels of claim 11, wherein the wall or the wall studs are adjacent to a shower base or a bathtub.

13. The kit of decorative wall panels of claim 9, wherein any the first connecting assembly or the second connecting assembly is configured to allow removably connecting the first wall panel, the second wall panel, or and the third wall panel.

14. The kit of decorative wall panels of claim 13, wherein each of the first connecting assembly and the second connecting assembly comprises a plurality of dowels and a corresponding plurality of pockets for receiving the plurality of dowels.

15. The kit of decorative wall panels of claim 9, wherein the front face of the first wall panel further comprises an upper portion that extends from the upper end to the at least one relief element and a lower portion that extends from the at least one relief element to the lower end of the first wall panel.

16. The kit of decorative wall panels of claim 15, wherein the upper portion of the front face of the first wall panel defines an upper decorative pattern and the lower portion of the front face defines a lower decorative pattern.

17. The kit of decorative wall panels of claim 16, wherein the upper decorative pattern and the lower decorative pattern define a faux-tile pattern comprising a series of horizontal lines extending across the front face of the first wall panel.

18. The kit of decorative wall panels of claim 17, wherein the horizontal lines of the lower decorative pattern are spaced a greater distance apart than the horizontal lines of the upper decorative pattern.

19. The kit of decorative wall panels of claim 18, wherein the second wall panel defines a second wall decorative pattern, and wherein the second wall decorative pattern has the same pattern as the upper decorative pattern of the first wall panel.

20. The kit of decorative wall panels of claim 19, wherein the third wall panel defines a third wall decorative pattern, and wherein the third wall decorative pattern has the same pattern as the upper decorative pattern of the first wall panel.

* * * * *